US011129443B2

(12) United States Patent
Craig

(10) Patent No.: US 11,129,443 B2
(45) **Date of Patent: *Sep. 28, 2021**

(54) FOOTWEAR UPPER INCORPORATING A KNITTED COMPONENT WITH SOCK AND TONGUE PORTIONS

(71) Applicant: NIKE, Inc., Beaverton, OR (US)

(72) Inventor: Kenneth T. Craig, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 18 days.

This patent is subject to a terminal disclaimer.

(21) Appl. No.: 16/555,364

(22) Filed: Aug. 29, 2019

(65) Prior Publication Data

US 2019/0380442 A1 Dec. 19, 2019

Related U.S. Application Data

(63) Continuation of application No. 15/293,829, filed on Oct. 14, 2016, now Pat. No. 10,561,200, which is a (Continued)

(51) Int. Cl.
*A43B 1/04* (2006.01)
*A43B 23/02* (2006.01)

(Continued)

(52) U.S. Cl.
CPC ..... *A43B 23/07* (2013.01); *A43B 1/04* (2013.01); *A43B 23/02* (2013.01); *A43B 23/021* (2013.01);

(Continued)

(58) Field of Classification Search
CPC ..... A43B 1/04; A43B 23/02; A43B 23/026; A43B 23/042; A43B 23/07; A43B 23/26; A41B 11/0005; A41B 11/02

(Continued)

(56) References Cited

U.S. PATENT DOCUMENTS 601,192 A 3/1898 Woodside
782,480 A 2/1905 Benndorf (Continued)

FOREIGN PATENT DOCUMENTS

CN 101248228 A 8/2008
CN 101583294 A 11/2009

(Continued)

OTHER PUBLICATIONS

Extended European Search Report dated Feb. 16, 2017, Application No. 16194437.6-1655.

(Continued)

*Primary Examiner* — Sharon M Prange
(74) *Attorney, Agent, or Firm* — Shook, Hardy & Bacon L.L.P.

(57) ABSTRACT

An upper for an article of footwear may be at least partially formed with a knitted component. The knitted component may include a sock portion and a tongue portion, the sock portion having a hollow structure and a toe area, the hollow structure (a) forming an ankle opening in a heel region of the footwear and (b) extending between the heel region and a forefoot region of the footwear to define a void within the footwear for receiving a foot. The tongue portion may have an elongate configuration (a) located in at least a portion of a length of a throat area of the upper and (b) including at least two knit layers that are coextensive.

19 Claims, 26 Drawing Sheets

Related U.S. Application Data continuation of application No. 13/681,766, filed on Nov. 20, 2012, now Pat. No. 9,498,023.

(51) Int. Cl.

| | |
|---|---|
| ***A43B 23/04*** | (2006.01) |
| ***A43B 23/26*** | (2006.01) |
| ***A43B 23/07*** | (2006.01) |
| ***D04B 1/26*** | (2006.01) |
| ***D04B 1/10*** | (2006.01) |
| ***A43C 1/04*** | (2006.01) |

(52) U.S. Cl.

CPC ..... *A43B 23/024* (2013.01); *A43B 23/026* (2013.01); *A43B 23/0215* (2013.01); *A43B 23/0245* (2013.01); *A43B 23/04* (2013.01); *A43B 23/042* (2013.01); *A43B 23/26* (2013.01); *A43C 1/04* (2013.01); *D04B 1/104* (2013.01); *D04B 1/106* (2013.01); *D04B 1/26* (2013.01); *D10B 2403/0113* (2013.01); *D10B 2403/021* (2013.01); *D10B 2403/023* (2013.01); *D10B 2501/043* (2013.01)

(58) Field of Classification Search

USPC ..... 36/99, 45, 54; 2/239–241

See application file for complete search history.

(56) References Cited

U.S. PATENT DOCUMENTS 1,215,198 A 2/1917 Rothstein
1,597,934 A 8/1926 Stimpson
1,601,020 A * 9/1926 Holden ..... A41B 11/005 66/178 R
1,799,016 A 3/1931 Jennings
1,888,172 A 11/1932 Joha
1,902,780 A 3/1933 Holden et al.
1,910,251 A 5/1933 Joha
2,001,293 A 5/1935 Wilson
2,047,724 A 7/1936 Zuckerman
2,069,819 A 2/1937 Diem
2,147,197 A 2/1939 Glidden
2,314,098 A 3/1943 McDonald
2,330,199 A 9/1943 Basch
2,343,390 A 3/1944 Ushakoff
2,400,692 A 5/1946 Herbert
2,422,410 A 6/1947 Albert
2,440,393 A 4/1948 Clark
2,569,764 A 10/1951 Jonas
2,586,045 A 2/1952 Hoza
2,608,078 A 8/1952 Anderson
2,641,004 A 6/1953 Whiting et al.
2,675,631 A 4/1954 Doughty
2,770,055 A 11/1956 Hayden
2,994,322 A 8/1961 Cullen et al.
3,583,081 A 6/1971 Hayashi
3,694,940 A 10/1972 Stohr
3,704,474 A 12/1972 Winkler
3,766,566 A 10/1973 Tadakoro
3,778,856 A 12/1973 Christie et al.
3,949,570 A 4/1976 Niederer
3,952,427 A 4/1976 Von den Benken et al.
3,972,086 A 8/1976 Belli et al.
4,027,402 A 6/1977 Liu et al.
4,031,586 A 6/1977 Von den Benken et al.
4,036,037 A 7/1977 Huckeldt
4,211,806 A 7/1980 Civardi et al.
4,232,458 A 11/1980 Bartels
4,255,949 A 3/1981 Thorneburg
4,258,480 A 3/1981 Famolare, Jr.
4,317,292 A 3/1982 Melton
4,341,096 A * 7/1982 Safrit ..... A41B 11/02 66/185
4,373,361 A 2/1983 Thorneburg
4,447,967 A 5/1984 Zaino
4,465,448 A 8/1984 Aldridge
4,607,439 A 8/1986 Harada
4,736,531 A 4/1988 Richard
4,737,396 A 4/1988 Karnat
4,750,339 A 6/1988 Simpson et al.
4,756,098 A 7/1988 Boggia
4,785,558 A 11/1988 Shiomura
4,813,158 A 3/1989 Brown
5,031,423 A 7/1991 Ikenaga
5,095,720 A 3/1992 Tibbals, Jr.
5,117,567 A 6/1992 Berger
5,149,583 A 9/1992 Saarikettu
5,152,025 A 10/1992 Hirmas
5,192,601 A 3/1993 Neisler
5,299,435 A 4/1994 Whalley
5,319,807 A 6/1994 Brier
5,345,638 A 9/1994 Nishida
5,353,524 A 10/1994 Brier
5,371,957 A 12/1994 Gaudio
5,416,961 A 5/1995 Vinay
5,421,034 A 6/1995 Keune
5,461,884 A 10/1995 McCartney et al.
5,473,781 A * 12/1995 Greenberg ..... A41B 11/003 2/239
5,499,459 A 3/1996 Tomaro
5,511,323 A 4/1996 Dahlgren
5,512,354 A 4/1996 Scholz
5,572,860 A 11/1996 Mitsumoto et al.
5,575,090 A 11/1996 Condini
5,608,976 A 3/1997 Marega et al.
5,623,840 A 4/1997 Roell
5,729,918 A 3/1998 Smets
5,735,145 A 4/1998 Pernick
5,746,013 A 5/1998 Fay, Sr.
5,765,296 A 6/1998 Ludemann et al.
5,765,400 A 6/1998 Roell
5,884,419 A 3/1999 Davidowitz et al.
5,970,629 A 10/1999 Tucker
5,996,189 A 12/1999 Wang
6,029,376 A 2/2000 Cass
6,032,387 A 3/2000 Johnson
6,052,921 A 4/2000 Oreck
6,082,148 A 7/2000 Wakai
6,088,936 A 7/2000 Bahl
6,151,802 A 11/2000 Reynolds
6,151,922 A 11/2000 Shimasaki
6,170,175 B1 1/2001 Funk
6,308,438 B1 10/2001 Thorneburg et al.
6,333,105 B1 12/2001 Tanaka et al.
6,401,364 B1 6/2002 Burt
6,558,784 B1 5/2003 Norton et al.
6,588,237 B2 7/2003 Cole et al.
6,754,983 B2 6/2004 Hatfield et al.
6,910,288 B2 6/2005 Dua
6,922,917 B2 8/2005 Kerns et al.
6,931,762 B1 8/2005 Dua
6,939,372 B2 9/2005 Dong
6,984,596 B2 1/2006 Dickerson
6,986,269 B2 * 1/2006 Dua ..... A43B 1/04 66/177
D517,297 S 3/2006 Jones et al.
7,051,460 B2 5/2006 Orei et al.
7,056,402 B2 6/2006 Koerwien et al.
7,201,024 B2 4/2007 Hirayama
7,347,011 B2 3/2008 Dua et al.
7,370,438 B2 5/2008 Vattes et al.
7,386,947 B2 6/2008 Martin et al.
7,441,348 B1 10/2008 Dawson
7,475,500 B2 1/2009 Covatch
7,543,397 B2 6/2009 Kilgore et al.
7,549,303 B2 6/2009 Callaway
7,568,298 B2 8/2009 Kerns
7,578,076 B2 8/2009 Pawlus et al.
7,682,219 B2 3/2010 Falla
7,774,956 B2 8/2010 Dua
8,132,340 B2 3/2012 Meschter
8,448,474 B1 5/2013 Tatler et al.
8,490,299 B2 7/2013 Dua et al.

(56) References Cited

U.S. PATENT DOCUMENTS

| | | | | |
|---|---|---|---|---|
| 8,505,220 | B2 | 8/2013 | James et al. | |
| 9,095,186 | B2 | 8/2015 | Follet | |
| 9,301,567 | B2 | 4/2016 | Dealey | |
| 9,510,637 | B2 | 12/2016 | Podhajny | |
| 9,661,892 | B2 | 5/2017 | Meir | |
| 9,803,299 | B2 | 10/2017 | Podhajny | |
| 9,848,672 | B2 | 12/2017 | Podhajny | |
| 9,936,757 | B2 | 4/2018 | Podhajny | |
| 2002/0078599 | A1 | 6/2002 | Delgorgue et al. | |
| 2002/0148258 | A1 | 10/2002 | Cole et al. | |
| 2002/0184927 | A1 | 12/2002 | Polegato | |
| 2003/0093919 | A1 | 5/2003 | Wang | |
| 2003/0126762 | A1 | 7/2003 | Tseng | |
| 2003/0191427 | A1 | 10/2003 | Jay et al. | |
| 2004/0118018 | A1 | 6/2004 | Dua | |
| 2004/0181972 | A1 | 9/2004 | Csorba | |
| 2004/0244221 | A1 | 12/2004 | Hall et al. | |
| 2005/0115284 | A1 | 6/2005 | Dua | |
| 2005/0155137 | A1 | 7/2005 | Berger | |
| 2005/0193592 | A1 | 9/2005 | Dua et al. | |
| 2005/0273988 | A1 | 12/2005 | Christy | |
| 2005/0284000 | A1 | 12/2005 | Kerns | |
| 2006/0059715 | A1 | 3/2006 | Aveni | |
| 2006/0130359 | A1 | 6/2006 | Dua et al. | |
| 2006/0162187 | A1 | 7/2006 | Byrnes et al. | |
| 2007/0022627 | A1 | 2/2007 | Sokolowski et al. | |
| 2007/0062067 | A1 | 3/2007 | Covatch | |
| 2007/0180730 | A1 | 8/2007 | Greene et al. | |
| 2007/0294920 | A1 | 12/2007 | Baychar | |
| 2008/0017294 | A1 | 1/2008 | Bailey et al. | |
| 2008/0078102 | A1 | 4/2008 | Kilgore et al. | |
| 2008/0110048 | A1 | 5/2008 | Dua et al. | |
| 2008/0134543 | A1 | 6/2008 | Klein | |
| 2008/0189830 | A1 | 8/2008 | Egglesfield | |
| 2008/0313939 | A1 | 12/2008 | Ardill | |
| 2009/0068908 | A1 | 3/2009 | Hinchcliff | |
| 2009/0100713 | A1 | 4/2009 | Adami et al. | |
| 2010/0051132 | A1 | 3/2010 | Glenn | |
| 2010/0154256 | A1 | 6/2010 | Dua | |
| 2010/0170651 | A1 | 7/2010 | Scherb et al. | |
| 2010/0186255 | A1 | 7/2010 | Avar et al. | |
| 2010/0251564 | A1 | 10/2010 | Meschter | |
| 2011/0023325 | A1* | 2/2011 | Wines ..... | A43B 3/242 36/100 |
| 2011/0030244 | A1 | 2/2011 | Motawi et al. | |
| 2011/0041359 | A1 | 2/2011 | Dojan et al. | |
| 2011/0078921 | A1 | 4/2011 | Greene et al. | |
| 2012/0233882 | A1 | 9/2012 | Huffa et al. | |
| 2012/0233884 | A1 | 9/2012 | Greene | |
| 2012/0255201 | A1 | 10/2012 | Little | |
| 2012/0266362 | A1 | 10/2012 | Craig | |
| 2013/0219636 | A1 | 8/2013 | Dojan et al. | |
| 2013/0340283 | A1 | 12/2013 | Bell et al. | |
| 2014/0068968 | A1 | 3/2014 | Podhajny et al. | |
| 2014/0150292 | A1 | 6/2014 | Podhajny et al. | |
| 2014/0245633 | A1 | 9/2014 | Podhajny | |
| 2015/0013187 | A1 | 1/2015 | Taniguchi et al. | |

FOREIGN PATENT DOCUMENTS

| | | | |
|---|---|---|---|
| CN | 103393256 | A | 11/2013 |
| CN | 103517647 | A | 1/2014 |
| CN | 203399745 | U | 1/2014 |
| CN | 103841851 | A | 6/2014 |
| DE | 870963 | | 3/1953 |
| DE | 1084173 | | 6/1960 |
| DE | 19738433 | A1 | 4/1998 |
| DE | 19728848 | A1 | 1/1999 |
| EP | 0090580 | A1 | 10/1983 |
| EP | 0279950 | A2 | 8/1988 |
| EP | 0448714 | A1 | 10/1991 |
| EP | 0728860 | A1 | 8/1996 |
| EP | 0758693 | A1 | 2/1997 |
| EP | 0898002 | A2 | 2/1999 |
| EP | 1233091 | A1 | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| EP | 2649898 | B1 | 6/2018 |
| FR | 2171172 | | 9/1973 |
| GB | 538865 | | 8/1941 |
| GB | 2018837 | A | 10/1979 |
| GB | 1603487 | | 11/1981 |
| JP | S63-257504 | A | 10/1988 |
| JP | H06-020408 | | 3/1994 |
| JP | 6-113905 | A | 4/1994 |
| JP | H07-003502 | A | 1/1995 |
| JP | 8-109553 | A | 4/1996 |
| JP | 11-302943 | A | 11/1999 |
| JP | 3148210 | | 1/2009 |
| JP | 2013-502301 | A | 1/2013 |
| JP | 2014-508009 | A | 4/2014 |
| NL | 7304678 | A | 10/1974 |
| WO | 90/03744 | A1 | 4/1990 |
| WO | 98/43506 | A1 | 10/1998 |
| WO | 00/32861 | A1 | 6/2000 |
| WO | 01/33987 | A1 | 5/2001 |
| WO | 02/31247 | A1 | 4/2002 |
| WO | 2004043184 | A1 | 5/2004 |
| WO | WO 2011/043998 | A2 | 4/2011 |
| WO | WO 2012/004162 | A1 | 1/2012 |

OTHER PUBLICATIONS

First Examination Report for Indian Patent Application No. 2794/CHENP/2015 dated Mar. 12, 2019, 5 pages.

Notification of Reason(s) for Refusal for Japanese Patent Application No. 2017-091560 dated Jan. 10, 2019; 8 pages.

Office Action dated May 10, 2018 for Japanese Application No. 2017-091560, 11 pages.

Office Action dated Aug. 30, 2018 for Japanese Application No. 2017-091560, 6 pages.

Declaration of Dr. Edward C. Frederick from the US Patent and Trademark Office Inter Partes Review of U.S. Pat. No. 7,347,011, 178 pages.

Extended European Search Report received for European Patent Application No. 18167267.6, dated Nov. 14, 2018, 6 pages.

Eberle et al., "Clothing Technology ; Sixth German Edition and Third English Edition", Verlag EuropaLehrmittel, Nourney, Vollmer GmbH & Co., D-42781 Haa-Guriten ; ISBN 3-8085-6223-4, Exhibit 1013 in IPR2013-00067, Nov. 28, D 2012, 3 pages.

Final Office Action received for U.S. Appl. No. 13/681,766, dated Mar. 9, 2016, 9 pages.

Final Office Action received for U.S. Appl. No. 15/293,829, dated Jan. 17, 2018, 14 pages.

Final Office Action received for U.S. Appl. No. 15/293,829, dated May 29, 2019, 9 pages.

International Preliminary Report on Patentability received for PCT Application No. PCT/US2013/070648, dated Jun. 4, 2015., 10 pages.

International Preliminary Report on Patentability received for PCT Patent Application No. PCT/US2012/028534, dated Sep. 17, 2013, 9 pages.

International Preliminary Report on Patentability received for PCT Patent Application No. PCT/US2012/028576, dated Sep. 17, 2013, 8 pages.

International Preliminary Report on Patentability received for PCT Patent Application No. PCT/US2015/029454, dated Dec. 29, 2016, 9 pages.

International Search Report and Written Opinion received for PCT Application No. PCT/US2013/070648, dated Apr. 10, 2014., 13 pages.

International Search Report and Written Opinion received for PCT Patent Application No. PCT/US2009/056795, dated Apr. 20, 2010, 16 pages.

International Search Report and Written Opinion received for PCT Patent Application No. PCT/US2012/028534, dated Oct. 17, 2012, 14 pages.

(56) References Cited

OTHER PUBLICATIONS

International Search Report and Written Opinion received for PCT Patent Application No. PCT/US2012/028559, dated Oct. 19, 2012, 9 pages.
International Search Report and Written Opinion received for PCT Patent Application No. PCT/US2012/028576, dated Oct. 1, 2012, 10 pages.
Office Action received for Taiwanese Patent Application No. 104118203, dated May 8, 2018, 4 pages (2 pages of English Translation and 2 pages of Official copy).
Letter from Bruce Huffa, Dec. 23, 2013, 71 pages.
Non-Final Office Action received for U.S. Appl. No. 13/681,766, dated Sep. 25, 2015, 10 pages.
Non-Final Office Action received for U.S. Appl. No. 15/293,829, dated Jan. 9, 2018, 14 pages.
Non-Final Office Action received for U.S. Appl. No. 15/293,829, dated Nov. 15, 2018, 10 pages.
Notice of Allowance received for U.S. Appl. No. 13/681,766, dated Sep. 2, 2016, 11 pages.
Notice of Allowance received for U.S. Appl. No. 15/293,829, dated Oct. 2, 2019, 5 pages.
Office Action received for Chinese Patent Application No. 201580043593.2, dated Dec. 22, 2017, 9 pages (2 pages of English Translation and 7 pages of Official copy).
Office Action received for Chinese Patent Application No. 201380060093.0, dated Dec. 15, 2015, 10 pages (4 pages of English Translation and 6 pages of Official copy).
Office Action received for European Patent Application No. 13818039.3, dated Jul. 21, 2015, 2 pages.
Office Action received for Japanese Patent Application No. 2016-573514, dated Jan. 10, 2018, 13 pages (7 pages of English Translation and 6 pages of Official copy).
Office Action received for Taiwanese Patent Application No. 104118203, dated Feb. 21, 2017, 20 pages (9 pages of English Translation and 11 pages of Official copy).
Spencer, David J. , "Knitting Technology, A comprehensive handbook and practical guide", Third Edition ; Woodhead Publishing Limited, Abington Hall, Abington Cambridge, CB1 6AH, England, ISBN 1855733331, Exhibit 1012 in IPR2013-00067, Nov. 28, 2012, 413 pages.
International Search Report and Written Opinion received for PCT Patent Application No. PCT/US2015/029454, dated Jul. 16, 2015, 13 pages.
Non-Final Office action received for U.S. Appl. No. 16/792,536, dated Jul. 9, 2021, 10 pages.

* cited by examiner

FOOTWEAR UPPER INCORPORATING A KNITTED COMPONENT WITH SOCK AND TONGUE PORTIONS

RELATED APPLICATIONS

This application is a continuation of U.S. patent application Ser. No. 15/293,829, filed Oct. 14, 2016, and entitled "Footwear Upper Incorporating A Knitted Component With Sock And Tongue Portions," which is a continuation of U.S. patent application Ser. No. 13/681,766, filed Nov. 20, 2012, and entitled "Footwear Upper Incorporating A Knitted Component With Sock And Tongue Portions" (and issued as U.S. Pat. No. 9,498,023 on Nov. 22, 2016). Each application listed in this paragraph is hereby incorporated by reference in its entirety.

BACKGROUND

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

A variety of material elements (e.g., textiles, polymer foam, polymer sheets, leather, synthetic leather) are conventionally utilized in manufacturing the upper. In athletic footwear, for example, the upper may have multiple layers that each include a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements utilized in the upper, therefore, waste may be decreased while increasing the manufacturing efficiency and recyclability of the upper.

FIGURE DESCRIPTIONS

The foregoing Summary and the following Detailed Description will be better understood when read in conjunction with the accompanying figures.

DETAILED DESCRIPTION

Figure 1:
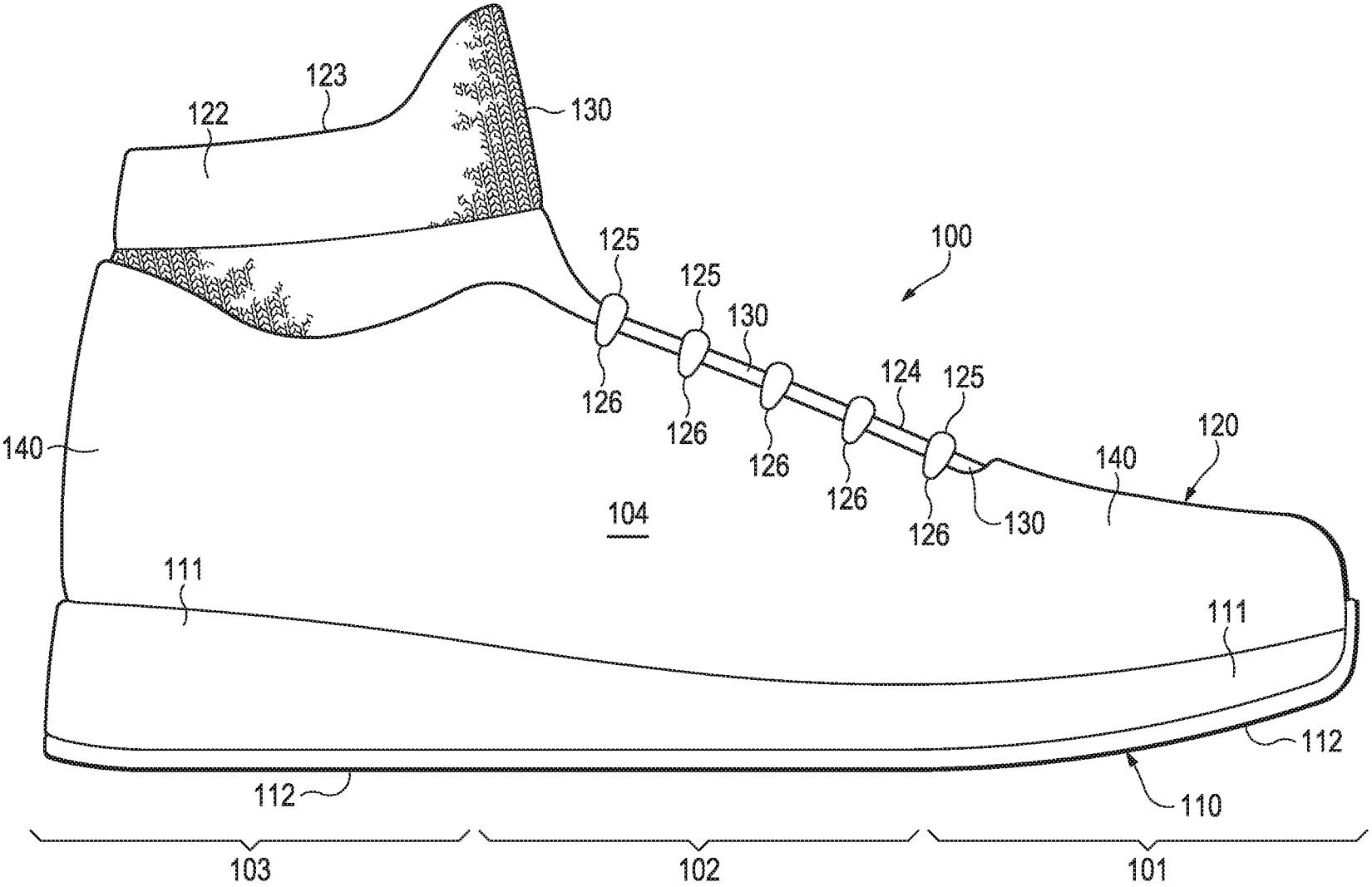
FIG. 1 is a lateral side elevational view of an article of footwear.
Figure 2:
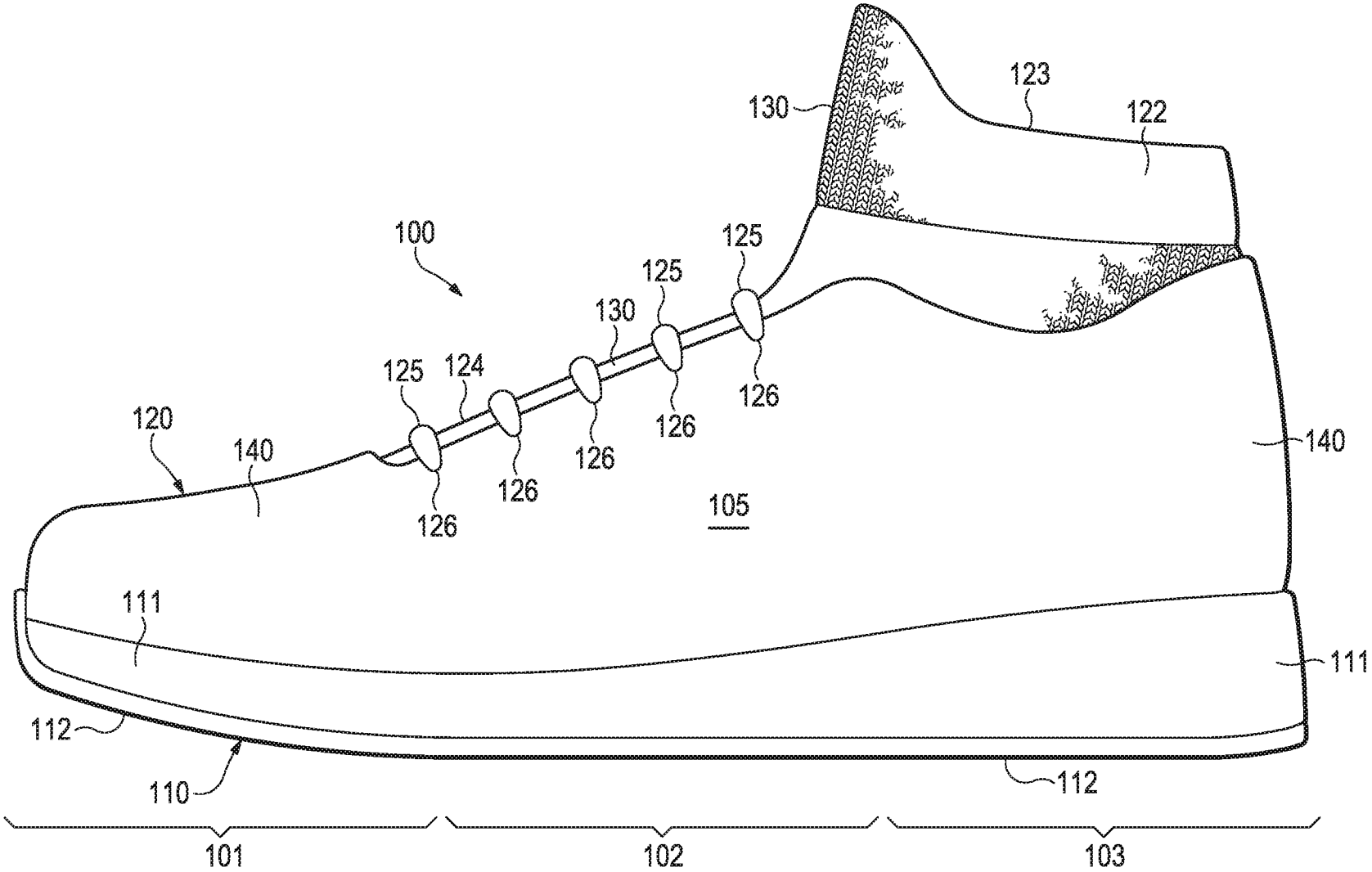
FIG. 2 is a medial side elevational view of the article of footwear.
Figure 3:
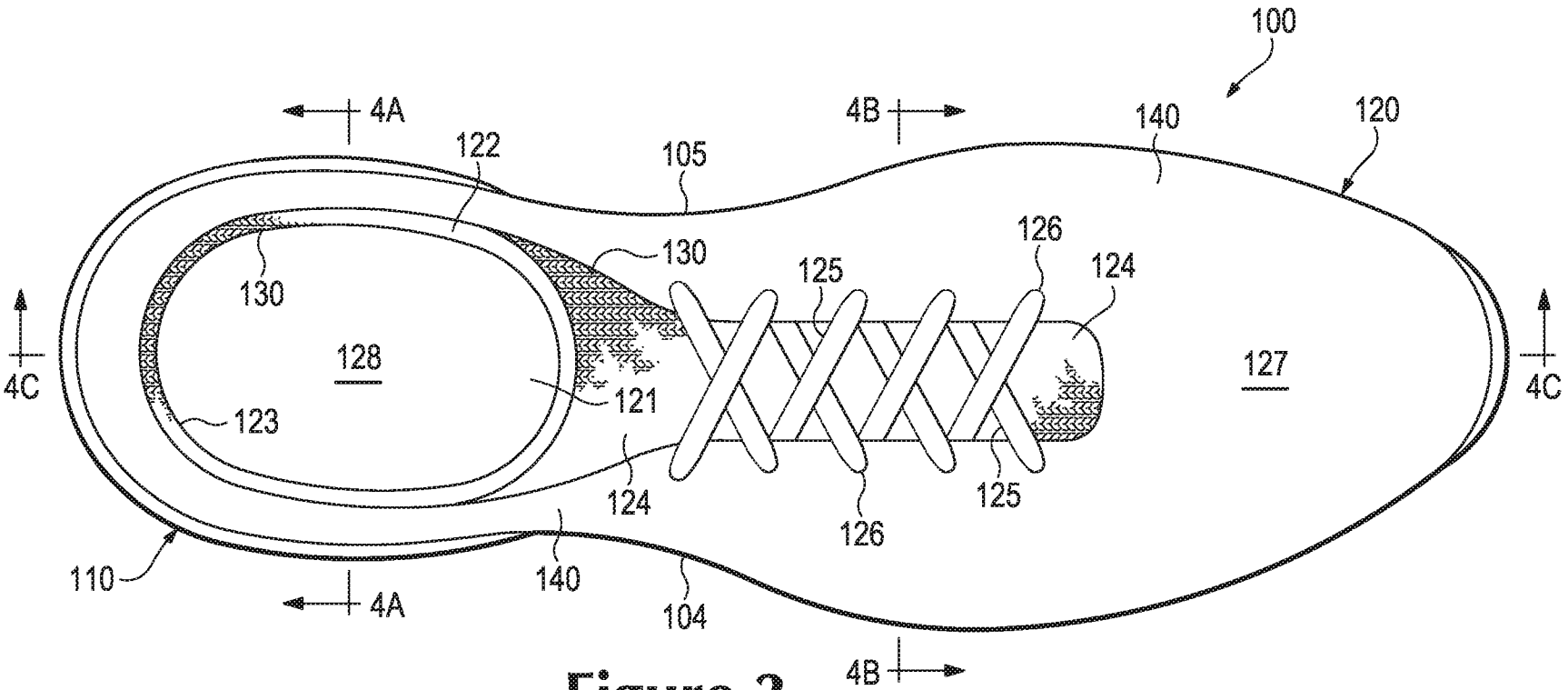
FIG. 3 is a top plan view of the article of footwear.
Figure 4A:
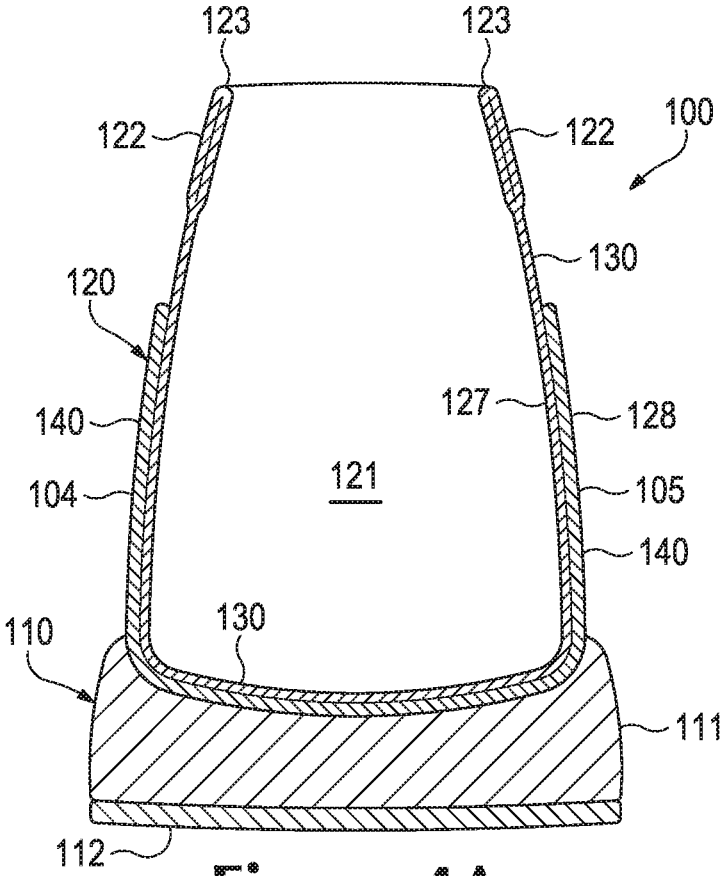
FIGS. 4A-4C are cross-sectional views of the article of footwear, as defined by section lines 4A-4C in FIG. 3.
Figure 4B:
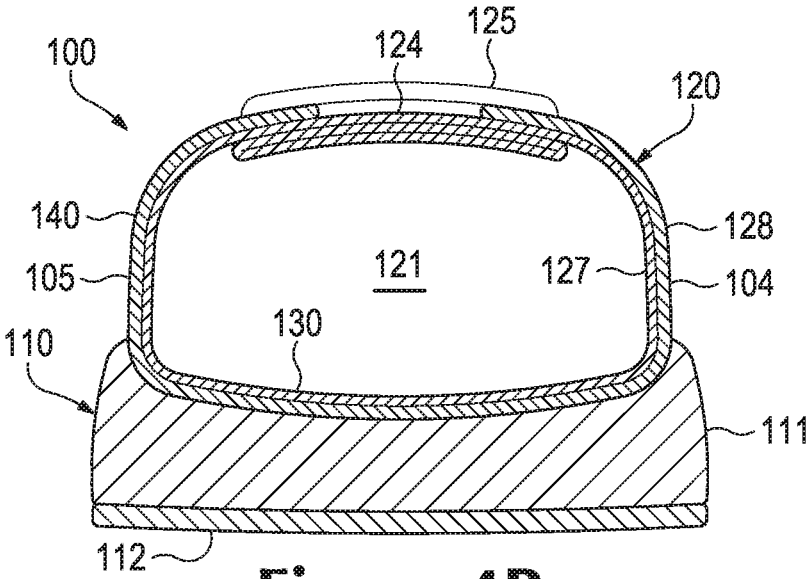
Figure 4C:
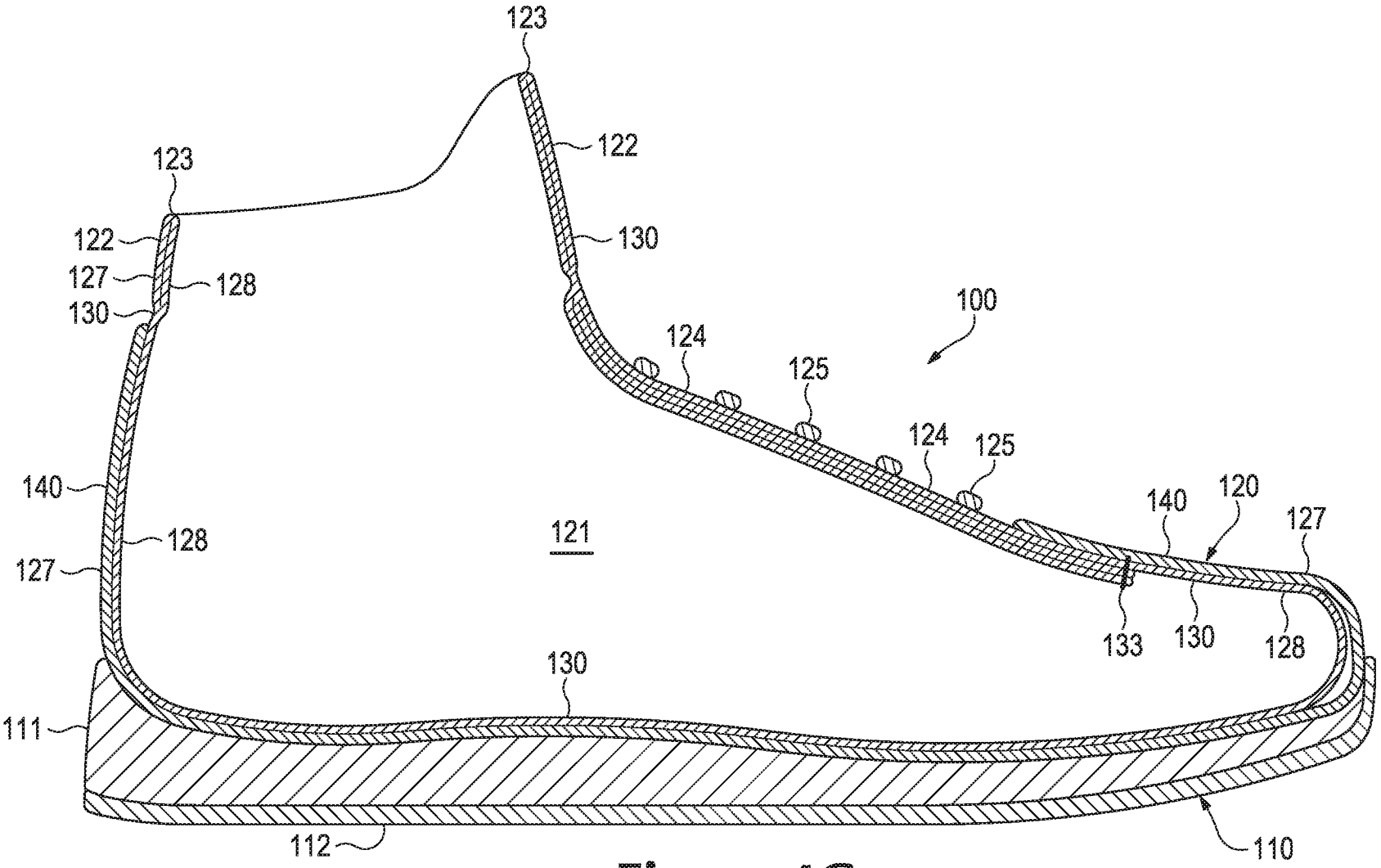

The following discussion and accompanying figures disclose a variety of concepts relating to knitted components and the manufacture of knitted components. Although the knitted components are disclosed with reference to articles of footwear having configurations that are suitable for running and basketball, concepts associated with the knitted components may be applied to a wide range of athletic footwear styles, including baseball shoes, football shoes, golf shoes, hiking shoes and boots, ski and snowboarding boots, soccer shoes, tennis shoes, training shoes, and walking shoes, for example. Concepts associated with the knitted components may also be utilized with footwear styles that are generally considered to be non-athletic, including dress shoes, loafers, sandals, and work boots. Accordingly, a variety of footwear styles and configurations may incorporate concepts discussed herein.

General Footwear Configuration

An article of footwear 100 is depicted in FIGS. 1-5 as including a sole structure 110 and an upper 120. Whereas sole structure 110 is located under and supports a foot of a wearer, upper 120 provides a comfortable and secure covering for the foot. As such, the foot may be located within upper 120 to effectively secure the foot within footwear 100 or otherwise unite the foot and footwear 100. Moreover, sole structure 110 is secured to a lower area of upper 120 and extends between the foot and the ground to attenuate ground reaction forces (i.e., cushion the foot), provide traction, enhance stability, and influence the motions of the foot, for example.

For reference purposes, footwear 100 may be divided into three general regions: a forefoot region 101, a midfoot region 102, and a heel region 103. Forefoot region 101 generally includes portions of footwear 100 corresponding with toes of the foot and the joints connecting the metatarsals with the phalanges. Midfoot region 102 generally includes portions of footwear 100 corresponding with an arch area of the foot. Heel region 103 generally corresponds with rear portions of the foot, including the calcaneus bone. Footwear 100 also includes a lateral side 104 and a medial side 105, which extend through each of regions 101-103 and correspond with opposite sides of footwear 100. More particularly, lateral side 104 corresponds with an outside area of the foot (i.e. the surface that faces away from the other foot), and medial side 105 corresponds with an inside area of the foot (i.e., the surface that faces toward the other foot). Regions 101-103 and sides 104-105 are not intended to demarcate precise areas of footwear 100. Rather, regions 101-103 and sides 104-105 are intended to represent general areas of footwear 100 to aid in the following discussion. In addition to footwear 100, regions 101-103 and sides 104-105 may also be applied to sole structure 110, upper 120, and individual elements thereof.

The primary elements of sole structure 110 are a midsole 111 and an outsole 112. Midsole 111 is secured to a lower surface of upper 120 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 111 may incorporate plates, moderators, fluid-filled chambers, lasting elements, or motion control members that further attenuate forces, enhance stability, or influence the motions of the foot, or midsole 111 may be primarily formed from a fluid-filled chamber. Outsole 112 is secured to a lower surface of midsole 111 and may be formed from a wear-resistant rubber material that is textured to impart traction. In addition, sole structure 110 may include a sockliner located within upper 120 and is positioned to extend under a lower surface of the foot to enhance the comfort of footwear 100. Although this configuration for sole structure 110 provides an example of a sole structure that may be used in connection with upper 120, a variety of other conventional or nonconventional configurations for sole structure 110 may also be utilized. Accordingly, the features of sole structure 110 or any sole structure utilized with upper 120 may vary considerably.

Upper 120 defines a void 121 within footwear 100 for receiving and securing a foot relative to sole structure 110. Void 121 is shaped to accommodate the foot. When the foot is located within void 121, therefore, upper 120 extends along a lateral side of the foot, along a medial side of the foot, over the foot, around the heel, and under the foot. A collar 122 is located in at least heel region 103 and forms an ankle opening 123 that provides the foot with access to void 121. When the foot is located within void 121, collar 122 and ankle opening 123 extend around or otherwise encircle the ankle. Upper 120 also has a lacing system located in a throat area 124 of upper 120, which is primarily located in midfoot region 102 and corresponds with an instep region or upper surface of the foot. The lacing system includes a lace 125 that extends (a) through various apertures 126 in upper 120 and (b) repeatedly across throat area 124. The lacing system assists with tightening upper 120 around the foot and loosening portions of upper 120 to allow entry and removal of the foot from void 121. As an alternative to the apertures 126, the lacing system may include other lace-receiving elements, such as D-rings, hooks, or various looped tensile strands. Further configurations of upper 120 may also include one or more of (a) a heel counter in heel region 103 for enhancing stability, (b) a toe guard in forefoot region 101 that is formed of a wear-resistant material, and (c) logos, trademarks, and placards with care instructions and material information. Accordingly, upper 120 may incorporate various features and elements, in addition to the features and elements discussed herein and shown in the figures.

A majority of upper 120 is formed from a knitted component 130 and a cover component 140. Knitted component 130 has a knitted structure and is formed of unitary knit construction (i.e., as a one-piece element) through a knitting process. When incorporated into upper 120, knitted component 130 extends through each of regions 101-103 and between sides 104 and 105. Although primarily located within upper 120, portions of knitted component 130 are exposed in heel region 103 and throat area 124. In addition to forming collar 122 and ankle opening 123, knitted component 130 defines a majority or the entirety of void 121. As such, a foot located within void 121 (or a sock covering the foot) will contact and lay against knitted component 130. Cover component 140 is secured to sole structure 110 and is located exterior of knitted component 130, thereby covering various areas of knitted component 130. As incorporated into footwear 100, cover component 140 extends through each of regions 101-103, between sides 104 and 105, and between knitted component 130 and sole structure 110. That is, a portion of cover component 140 may extend between throat area 124 and an area where upper 120 is secured to sole structure 110. Although the structure of cover component 140 may vary significantly, cover component 140 may be formed from multiple material elements (e.g., textiles, polymer foam, polymer sheets, leather, synthetic leather) that are joined through stitching or bonding, for example. Moreover, cover component 140 may have a layered structure that includes multiple overlapping material elements.

Figure 5:
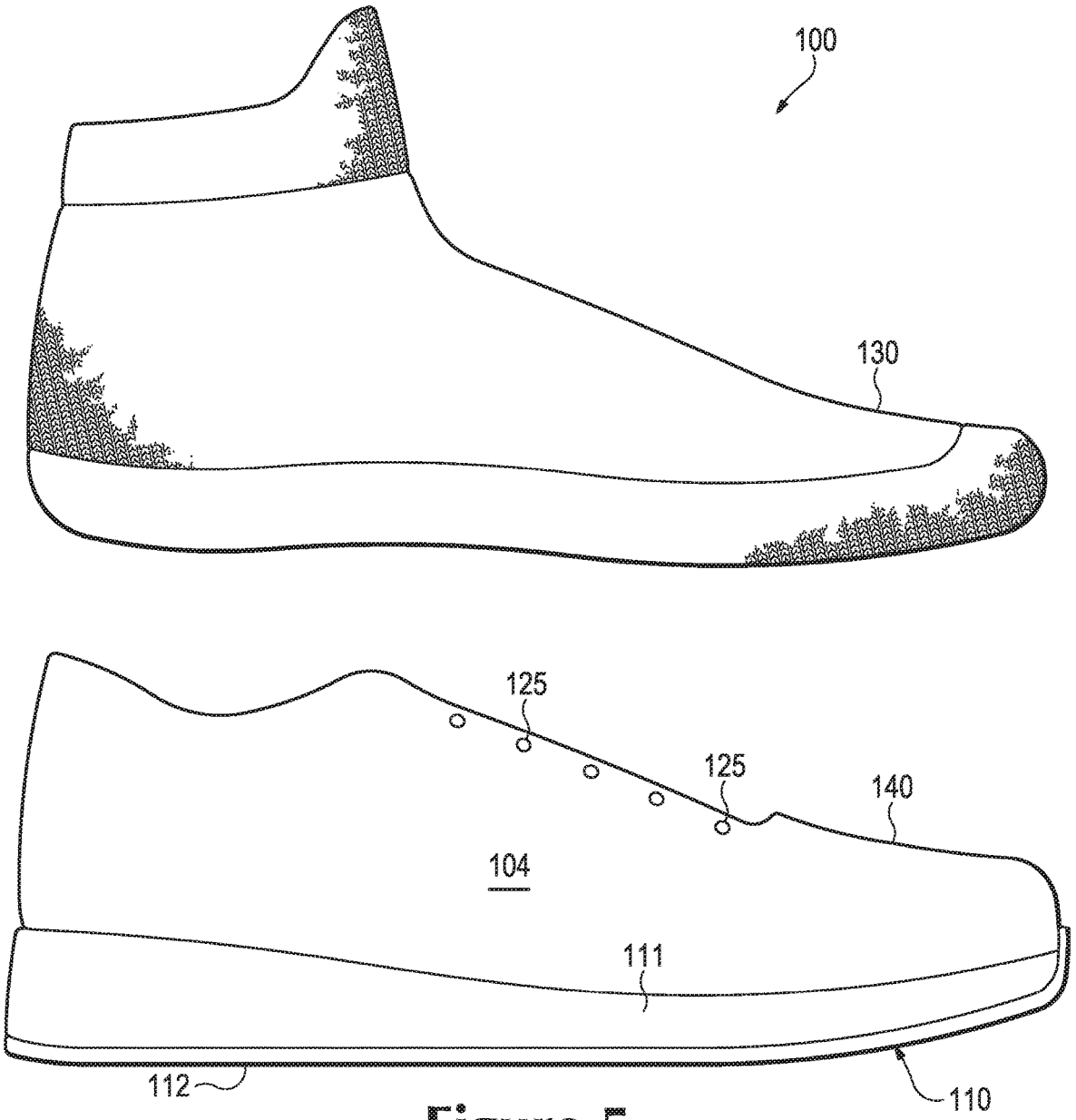
FIG. 5 is an exploded lateral side elevational view of the article of footwear.
Figure 6:
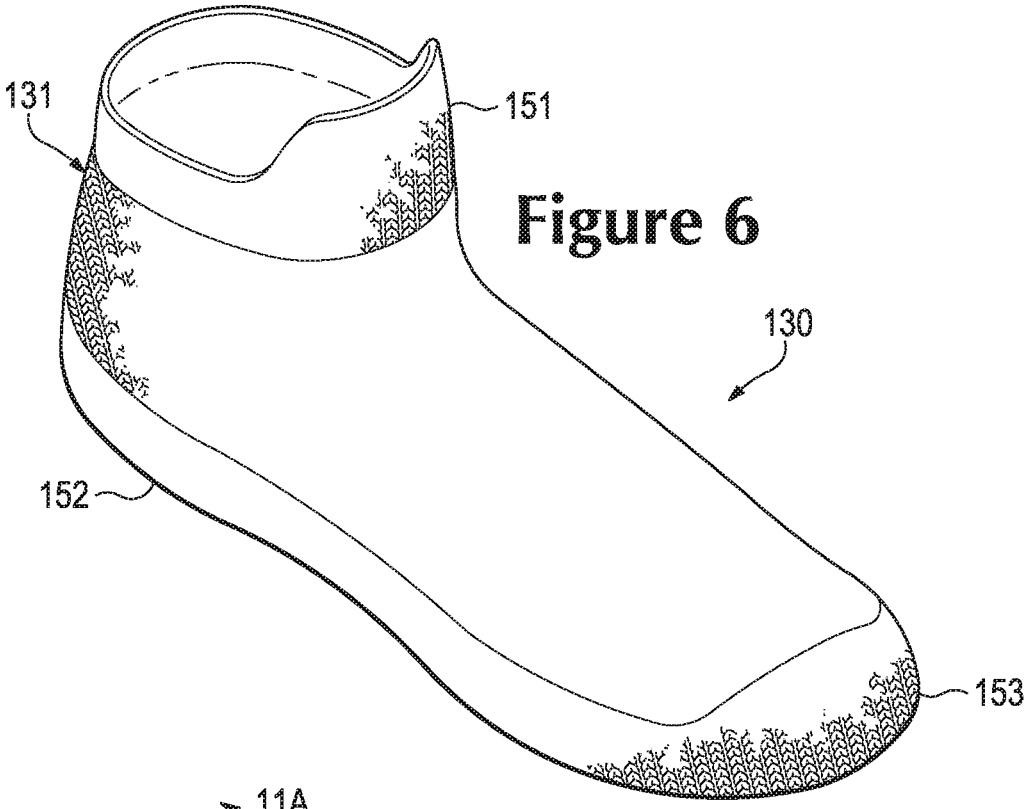
FIG. 6 is a perspective view of a knitted component that forms a portion of an upper of the article of footwear.
Figure 7:
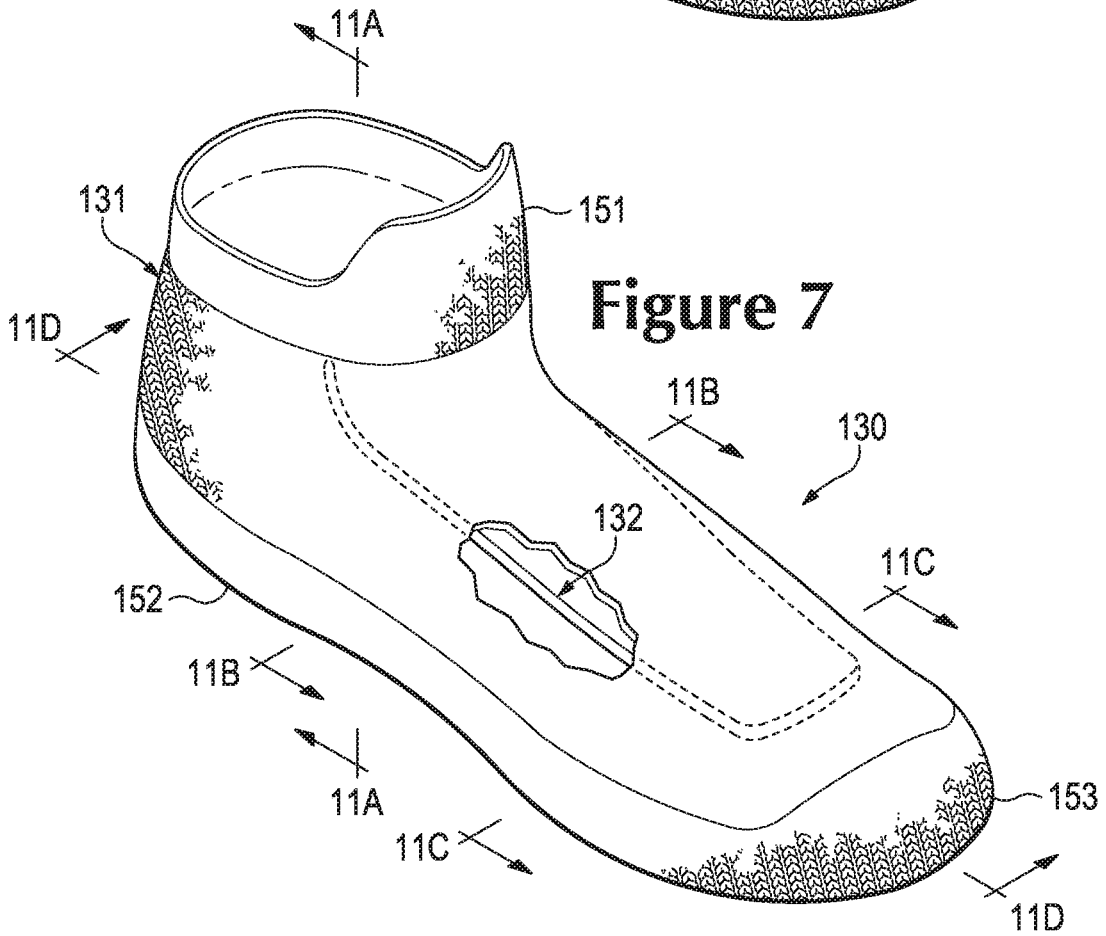
FIG. 7 is a perspective view corresponding with FIG. 6 and showing an interior portion of the knitted component.
Figure 8:
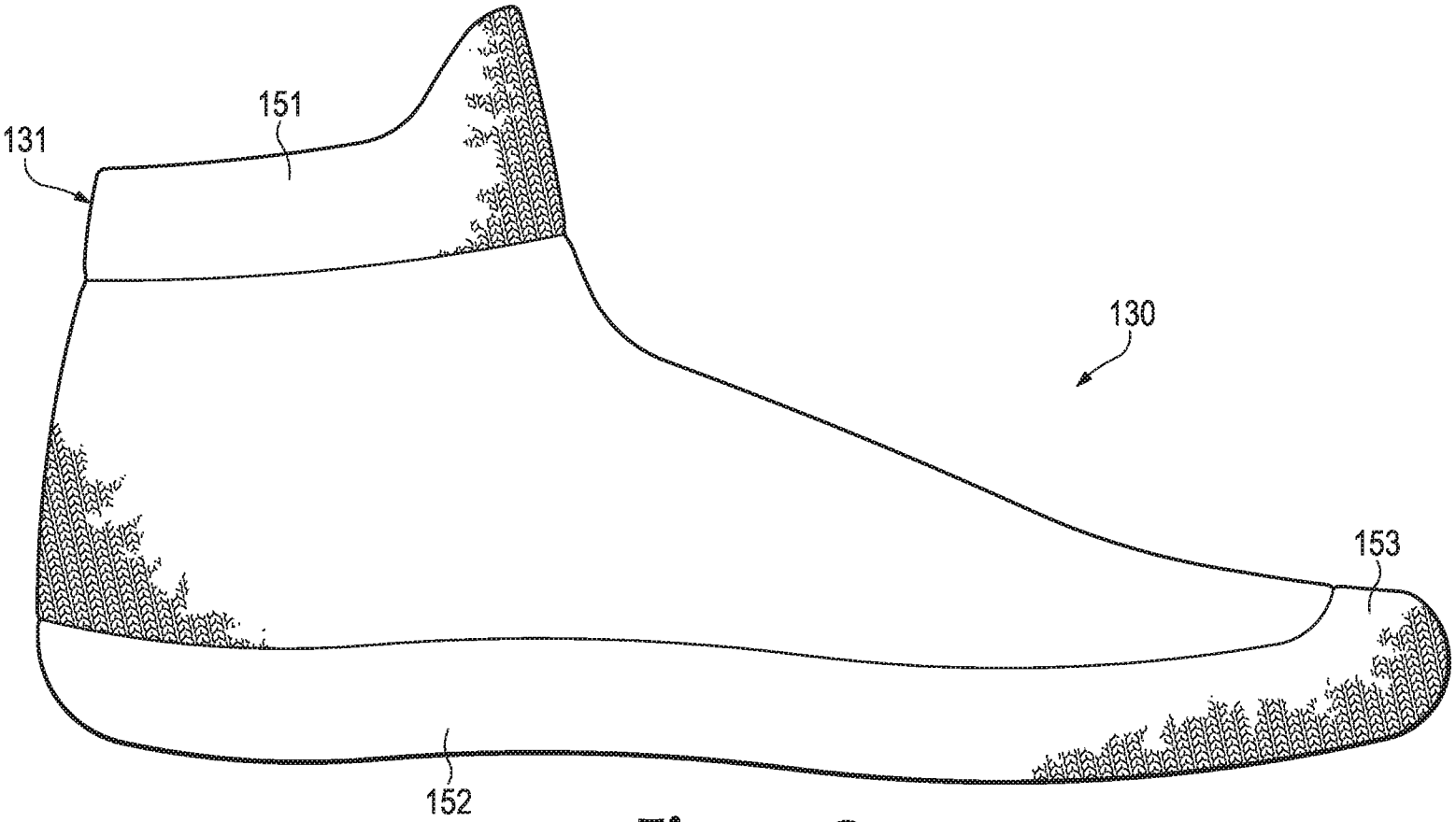
FIG. 8 is a lateral side elevational view of the knitted component.
Figure 9:
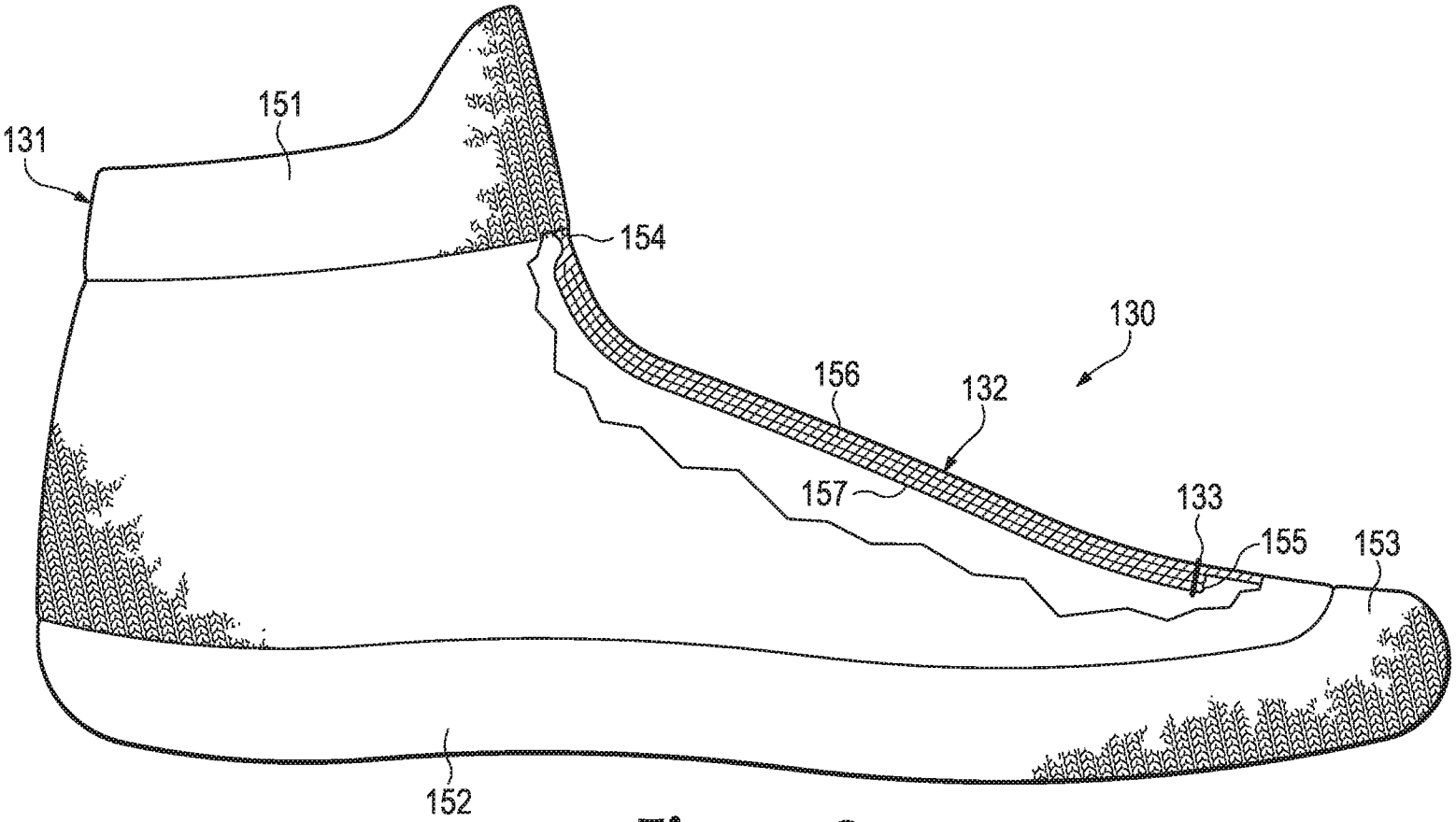
FIG. 9 is a lateral side elevational view corresponding with FIG. 8 and showing the interior portion of the knitted component.
Figure 10:
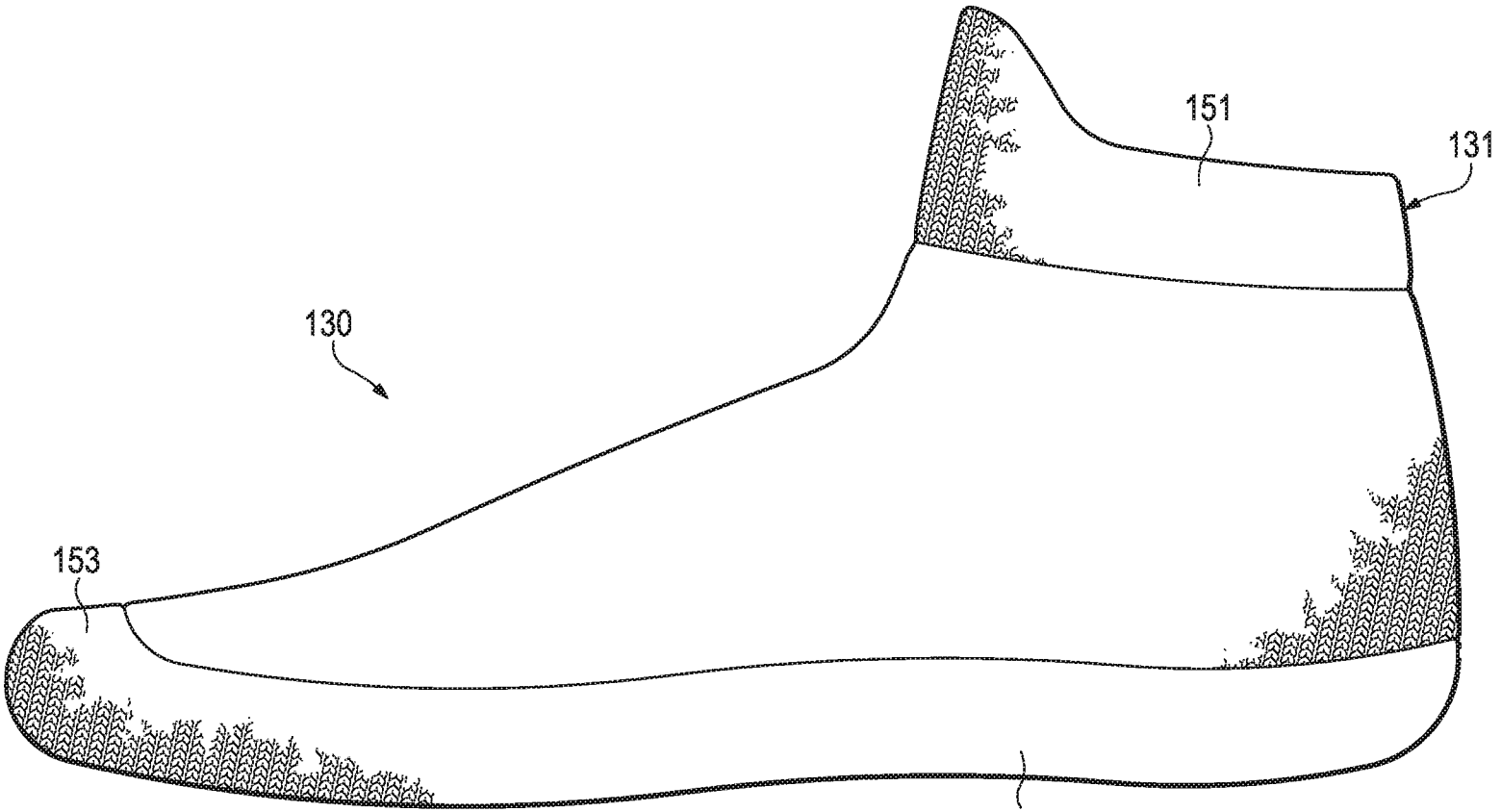
FIG. 10 is a medial side elevational view of the knitted component.
Figure 11A:
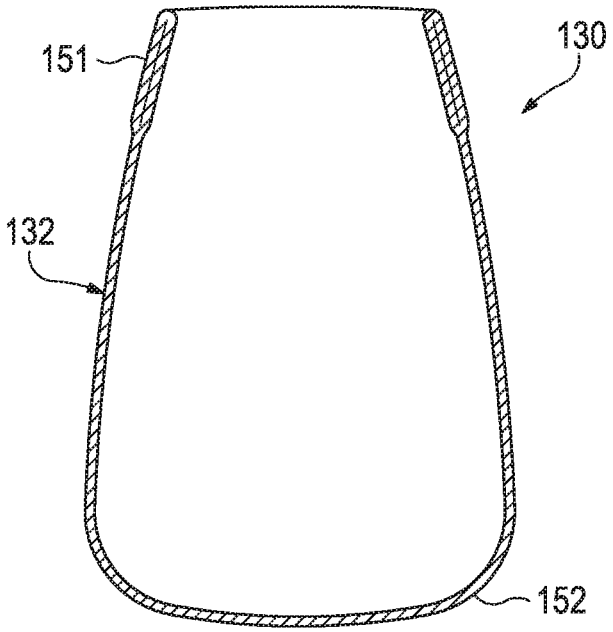
FIGS. 11A-11D are cross-sectional views of the knitted component, as defined by section lines 11A-11D in FIG. 7.
Figure 11B:
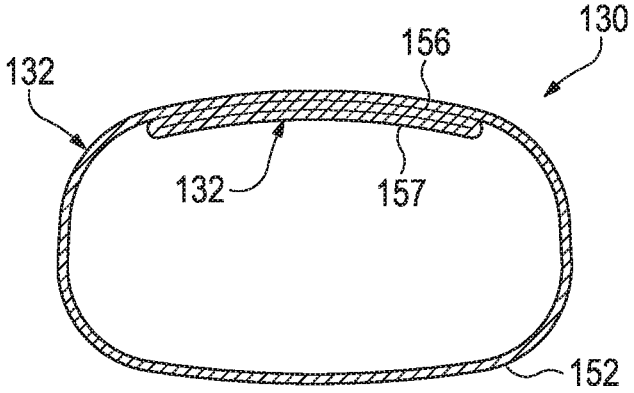
Figure 11C:
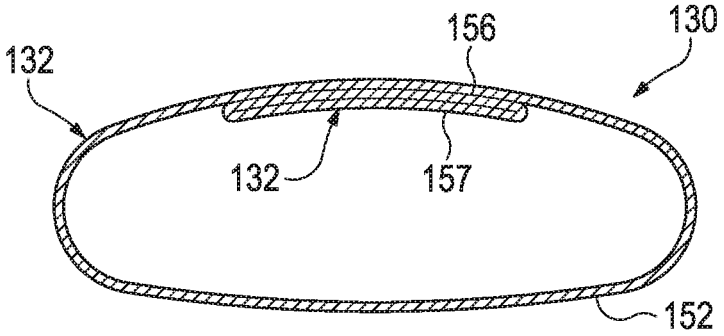
Figure 11D:
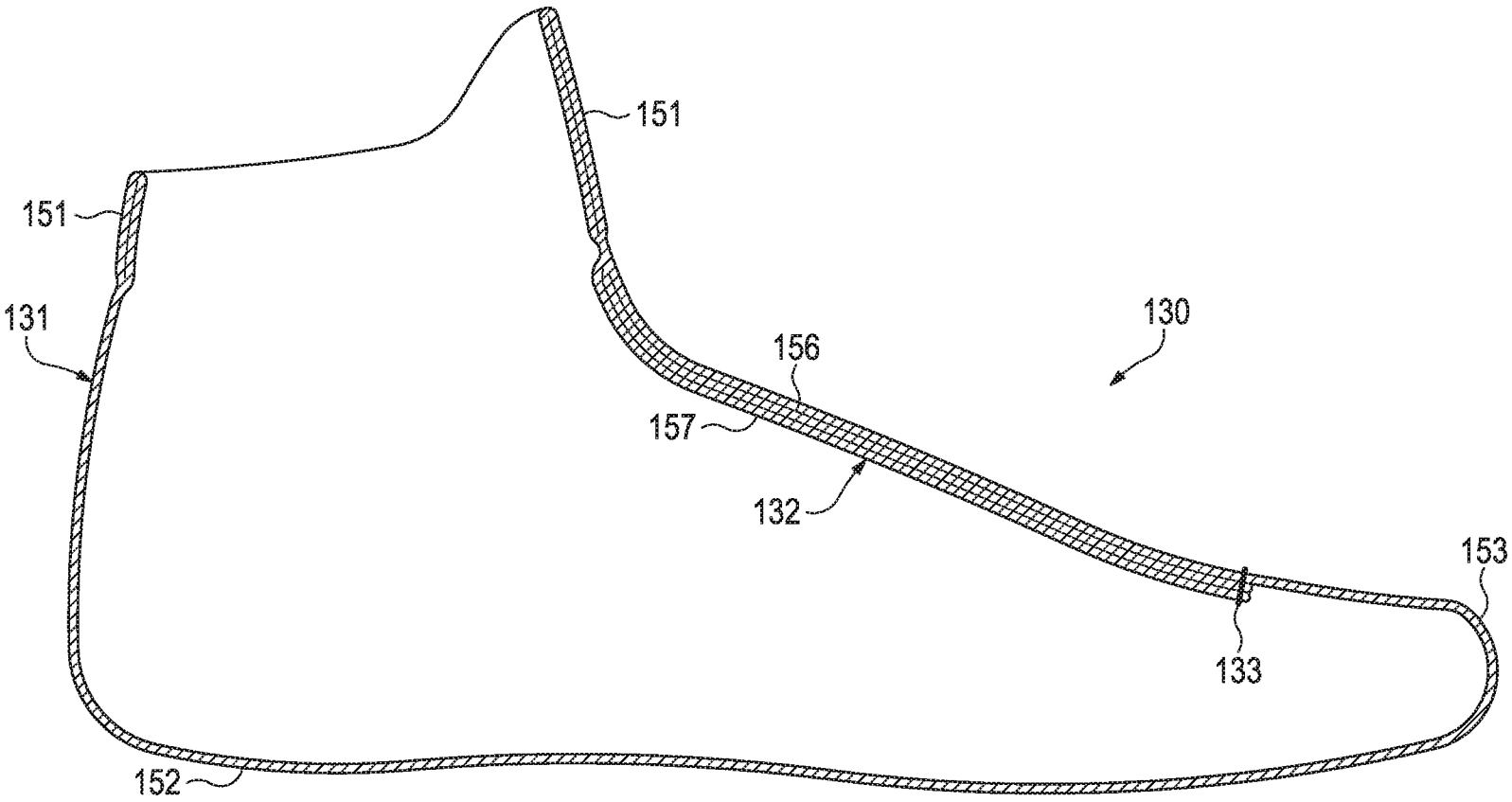

Knitted component 130 is separable and may be removed from a remainder of footwear 100, as depicted in FIG. 5. That is, knitted component 130 is not secured to other portions of upper 120 and may be repeatedly removed from and inserted within cover component 140. In order to place footwear 100 upon the foot, the wearer may first place knitted component 130 upon the foot, and then locate the foot and knitted component 130 within cover component 140. Alternately, the wearer may first place knitted component 130 within cover component 140, and then locate the foot within knitted component 130. Although components 130 and 140 are separable, knitted component 130 may be secured (e.g., through stitching, adhesive bonding, thermal bonding) to cover component 140 or other portions of upper 120 in some configurations of footwear 100.

Upper 120 includes an exterior surface 127 and an opposite interior surface 128. Exterior surface 127 is a portion of an outer surface of footwear 100 and is primarily formed by both of knitted component 130 and cover component 140. Knitted component 130 is exposed in heel region 103 and throat area 124, thereby forming portions of exterior surface 127 in these areas. Similarly, cover component 140 forms portions of exterior surface 127 between throat area 124 and sole structure 110. Whereas exterior surface 127 is cooperatively formed by each of knitted component 130 and cover component 140, knitted component 130 form a majority or all of interior surface 128, which also defines a portion of void 121. As such, a foot located within knitted component 130 will contact portions of interior surface 128.

Advantages of knitted component 130 include stretch and recovery properties, as well as enhanced fit and comfort. When locating the foot within void 121, collar 122 may stretch to permit the foot to enter void 121 through ankle opening 123. As the foot progresses into upper 120, portions of knitted component 130 located in throat area 124 may also stretch to permit the foot to fully enter void 121. In addition to stretching, knitted component may recover or contract to secure the foot within upper 120. More particularly, collar 122 may recover to securely extend around the ankle, and other portions of knitted component 130 may recover to draw cover component 140 against the foot, thereby tightening upper 120 around the foot. Various features of knitted component 130, including materials and knit structure, may be utilized to impart specific stretch and recovery properties to knitted component 130. That is, the degree of stretch and recovery may be engineered into knitted component 130. As a result, knitted component 130 may be designed to extend around the ankle and tighten upper 120 around the foot in a manner that enhances the overall fit of footwear 100. In addition, knitted component 130 may be designed with additional layers or padded portions in throat area 124 to separate and cushion the foot from lace 125. Moreover, knitted component 130 lays against the foot and enhances the overall comfort of footwear 100.

Knitted Component Configuration

Knitted component 130 is depicted individually and separate from a remainder of footwear 100 in FIGS. 6-11 D. Although a knitting process for manufacturing knitted component 130 will be discussed in greater detail below, knitted component 130 is formed from at least one yarn that is manipulated (e.g., with a knitting machine) to form a plurality of intermeshed loops that define a variety of courses and wales. That is, knitted component 130 has the structure of a knit textile. Moreover, knitted component 130 is formed of unitary knit construction. As utilized herein, a knitted component (e.g., knitted component 130) is defined as being formed of "unitary knit construction" when formed as a one-piece element through a knitting process. That is, the knitting process substantially forms the various features and structures of knitted component 130 without the need for significant additional manufacturing steps or processes. Although portions of knitted component 130 may be joined to each other (e.g., edges of knitted component 130 being joined together) following the knitting process, knitted component 130 remains formed of unitary knit construction because it is formed as a one-piece knit element. Additionally, knitted component 130 remains formed of unitary knit construction when other elements (e.g., stabilizers, stretch-limiting elements, straps, aesthetic features, logos, trademarks, and placards are added following the knitting process.

Although the configuration of knitted component 130 may vary considerably, knitted component 130 is depicted as including a sock portion 131 and a tongue portion 132. Sock portion 131 has the general configuration of a sock and forms, therefore, a generally cylindrical and hollow structure for receiving a foot. Tongue portion 132 is located within sock portion 131 and has an elongate structure that extends along a majority of a length of sock portion 131. When incorporated into footwear 100, sock portion 131 forms collar 122, defines ankle opening 123, and extends throughout the length and width of footwear 100. Tongue portion 132 is located in and extends through throat area 124 or at least a portion of throat area 124. Moreover, tongue portion 132 is positioned to extend between the foot and lace 125 to separate and cushion the foot from lace 125.

Sock portion 131 generally includes a collar area 151, a foot area 152, and a toe area 153. Collar area 151 forms an opening that provides access to the interior of knitted component 130. As such, collar area 151 forms collar 122 and defines ankle opening 123 in footwear 100. Although collar area 151 is depicted as having a two-layer configuration, portions of collar area 151 may also be formed from a single knit layer. Foot area 152 forms the majority of sock portion 131 and provides the generally cylindrical and hollow structure of sock portion 131 in which the foot is located. Toe area 153 is located opposite collar area 141 and forms a closed end of sock portion 131 that receives the toes of the wearer. Based upon this discussion, and as noted above, sock portion 131 has the general configuration of a sock and may have the general configuration of a variety of conventional socks. That is, sock portion 131 may incorporate various features and knit structures that are commonly utilized in socks that are intended to cover a foot. Given the unique use for knitted component 130, sock portion 131 may also incorporate various non-conventional structures that differ from those found in conventional socks.

Tongue portion 132 extends longitudinally through foot area 152 and is secured to opposite sides of foot area 152. More particularly, a collar end 154 of tongue portion 132 is secured to sock portion 131 adjacent to collar area 151, and an opposite toe end 155 of tongue portion 132 is secured to sock portion 131 adjacent to toe area 153. Although the area between ends 154 and 155 may be secured to sock portion 131, this area is depicted as being unsecured. As discussed in greater detail below, tongue portion 132 may be formed of unitary knit construction with sock portion 131. As such, one or both of ends 154 and 155 may be formed of unitary knit construction with sock portion 131. In the example configuration depicted in the figures, however, toe end 155 is joined to sock portion 131 with stitching 133, whereas collar end 154 is formed of unitary knit construction with sock portion 131.

Although tongue portion 132 may be formed from a single layer of textile material, tongue portion 132 is depicted as including a first knit layer 156 and a second knit layer 157 that are substantially coextensive and lay against each other. First knit layer 156 also lays against sock portion 131. Knit layers 156 and 157 are formed during the knitting process and joined to each other through the knitting process, thereby being formed of unitary knit construction. Although the specific locations in which knit layers 156 and 157 are joined may vary, edges or peripheral areas of knit layers 156 and 157 are depicted as being joined to each other, whereas central areas of knit layers 156 and 157 are depicted as being unjoined to each other. In effect, therefore, knit layers 156 and 157 are separate layers of knitted material, but are joined at their peripheries. An advantage of joining knit layers 156 and 157 relates to retaining the relative positions of knit layers 156 and 157 following the knitting process and while knitted component 130 or footwear 100 is being worn. In other configurations of knitted component 130, however, the peripheral areas of knit layers 156 and 157 may be unjoined or both the peripheral and central areas may be joined.

Knitted component 130 is formed of unitary knit construction, but knitted component 130 may include stitching 133 that joins toe end 155 to sock portion 131. During the knitting process for knitted component 130, which is discussed in greater detail below, each of sock portion 131 and tongue portion 132 are formed and joined together. More particularly, the knitting process joins collar end 154 to sock portion 131. Once the knitting process is complete, toe end 155 is joined to sock portion 131 with stitching 133. In further configurations, the knitting process may join toe end 155 to sock portion 131, and stitching 133 may be located at collar end 154. It may also be possible to join both of ends 154 and 155 during the knitting process, thereby eliminating the need for stitching 133.

An advantage of forming tongue portion 132 to include both of knit layers 156 and 157 relates to providing additional separation and cushioning between the foot and lace 125. When incorporated into footwear 100, both of knit layers 156 and 157 are positioned between the foot and lace 125. Moreover, a portion of sock portion 131 also extends between the foot and lace 125. In effect, therefore, three layers of knit material separate the foot from lace 125 in throat area 124, whereas other portions of knitted component (e.g., sock portion 131) may have a single layer that separates the foot from other portions of upper 120. Each of the knit layers imparts a degree of cushioning that protects the foot from lace 125. In combination, however, the three knit layers provide greater separation and cushioning, thereby enhancing the overall comfort of footwear 100. In some configurations, tongue portion 132 may include only one knit layer or may include three or more knit layers. In other configurations, a foam material or other element may be utilized to provide even further separation and cushioning between the foot and lace 125.

Knitted component 130 may be formed from a single type of yarn that imparts common properties to each of sock portion 131 and tongue portion 132. In order to vary the properties of knitted component 130, however, different yarns may be utilized in different areas of knitted component 130. That is, portions 131 and 132 or different areas of portions 131 and 132 may be formed from different yarns to vary the properties between areas of knitted component 130. Moreover, one area of knitted component 130 may be formed from a first type of yarn or combination of yarns that imparts a first set of properties, and another area of knitted component 130 may be formed from a second type of yarn or combination of yarns that imparts a second set of properties. Properties may vary throughout knitted component 130, therefore, by selecting specific yarns for different areas of knitted component 130. Examples of properties that may be varied through choice of yarn include color, pattern, luster, stretch, recovery, loft, hand, moisture absorption, biodegradability, abrasion-resistance, durability, and thermal conductivity. It should also be noted that two or more yarns may be utilized in combination to take advantage of properties from both yarns, such as when yarns are plated or form different courses in the same area.

The properties that a particular type of yarn will impart to an area of knitted component 130 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is durable, abrasion-resistant, and has relatively high strength. Polyester is a hydrophobic material that also provides relatively high durability. Yarns that incorporate thermoplastic materials may also permit areas of knitted component 130 to be fused or stabilized through the application of heat. In addition to materials, other aspects of the yarns selected for knitted component 130 may affect properties. For example, a yarn forming knitted component 130 may be a monofilament yarn or a multifilament yarn. The yarn may also include separate filaments that are each formed of different materials. In addition, the yarn may include filaments that are each formed of two or more different materials, such as a bi-component yarn with filaments having a sheath-core configuration or two halves formed of different materials. Different degrees of twist and crimping, as well as different deniers, may also affect the properties of knitted component 130. Accordingly, both the materials forming the yarn and other aspects of the yarn may be selected to impart a variety of properties to separate areas of knitted component 130.

In addition to the type of yarn that is selected for knitted component 130, the knit structure in knitted component 130 imparts particular properties. As depicted, a majority of knitted component 130 is formed to have a common or single knit structure, which is relatively untextured and may be referred to as a tubular or plain knit. In further configurations, however, knitted component 130 may have a rib knit structure or mesh knit structure, or knitted component 130 may have a hybrid knit structure in which multiple types of knit structures are utilized in one area. In order to vary the properties of knitted component 130, different knit structures may be utilized in different areas of knitted component 130. That is, portions 131 and 132 or different areas of 131 and 132 may be formed from different knit structures to vary the properties between areas of knitted component 130. Moreover, one area of knitted component 130 may be formed from a first knit structure or combination of knit structures that imparts a first set of properties, and another area of knitted component 130 may be formed from a second knit structure or combination of knit structures that imparts a second set of properties. Properties may vary throughout knitted component 130, therefore, by selecting specific knit structures for different areas of knitted component 130. Examples of properties that may be varied through choice of yarn include pattern, luster, stretch, recovery, loft, hand, moisture absorption, abrasion-resistance, durability, and thermal conductivity.

Properties may be further varied by selecting both the type of yarn and the knit structure that is utilized in knitted component 130 or areas of knitted component 130. By combining various types of yarn with various knit structures, further combinations of properties may be imparted to knitted component 130. For example, a first type of yarn and a first knit structure may be utilized in one area of knitted component 130 to provide a set of properties, and a second type of yarn and a second knit structure may be utilized in a different area of knitted component 130 to provide a different set of properties. As an example, sock portion 131 may incorporate types of yarn and knit structures that impart high stretch, and tongue portion 132 may incorporate types of yarn and knit structures that impart loft and low stretch. Given the two-layer configuration in collar area 151, the outer layer may incorporate types of yarn and knit structures that impart durability and wear-resistance, and the inner layer may incorporate types of yarn and knit structures that impart stretch and recovery. Additionally, some portions of foot area 152 may have a rib knit structure with a higher denier yarn, and other portions of foot area 152 may have a plain knit structure with a lower denier yarn. Portions of sock portion 131 may also incorporate types of yarn and knit structures wick moisture away from the foot. Accordingly, selecting particular combinations of types of yarn and knit structures for each area of knitted component 130 permits each area to have a particular combination of beneficial properties.

An advantage of footwear 100 relates to the separability of knitted component 130 from a remainder of footwear 100. Different individuals have different foot shapes and proportions, as well as different preferences regarding various aspects of footwear. Each individual may, therefore select a configuration of knitted component 130 that best suits their proportions and preferences. Moreover, an individual may replace one knitted component 130 with another knitted component 130 based upon the intended activity that footwear 100 is intended to be worn during. The ability to replace knitted component 130 also permits footwear 100 to have various aesthetics, depending upon which knitted component 130 is worn. Accordingly, various aspects of footwear 100 may vary depending upon the specific configuration of knitted component 130 that is used with footwear 100.

Although separability imparts various advantages, non-separable configurations also have various advantages. For example, knitted component 130 provides an essentially seamless surface that rests against the foot, thereby enhancing the comfort of footwear 100. Moreover, the use of knitted component 130 increases the efficiency of manufacturing footwear 100 and decreases the number of separate elements that must be joined in making upper 120.

Based upon the above discussion, a portion of upper 120 incorporates knitted component 130, which is formed of unitary knit construction. Knitted component 130 may include both sock portion 131 and tongue portion 132. Sock portion 131 has a generally cylindrical and hollow structure that forms ankle opening 123 extends between regions 101 and 103 to define void 121. Tongue portion 132 has an elongate configuration (a) extending through at least a portion of a length of throat area 124 and (b) including two knit layers 156 and 157 that lay adjacent to each other. One of knit layers 156 and 157 may also lay against sock portion 131 in throat area 124. Given this structure, a majority of knitted component 131 is formed from sock portion 131, which often is a single knit layer. In throat area 124, however, upper 120 has a layered structure that includes the knit layer of sock portion 131 and each of knit layers 156 and 157. Moreover, each of portions 131 and 132 and the three knit layers are formed of unitary knit construction.

Further Configurations

Figure 12A:
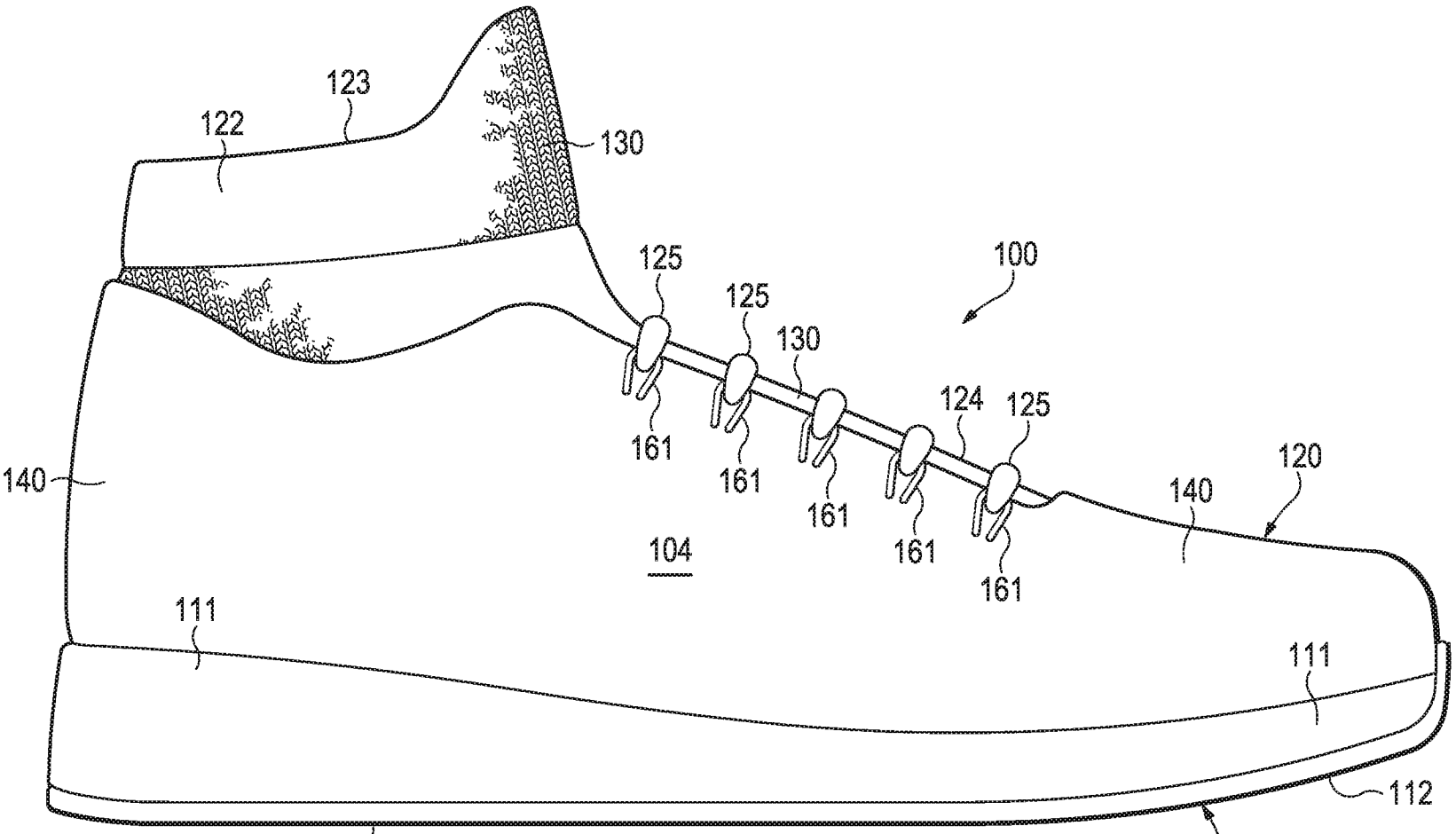
FIGS. 12A-12C are lateral side elevational views corresponding with FIG. 1 and depicting further configurations of the article of footwear.
Figure 12B:
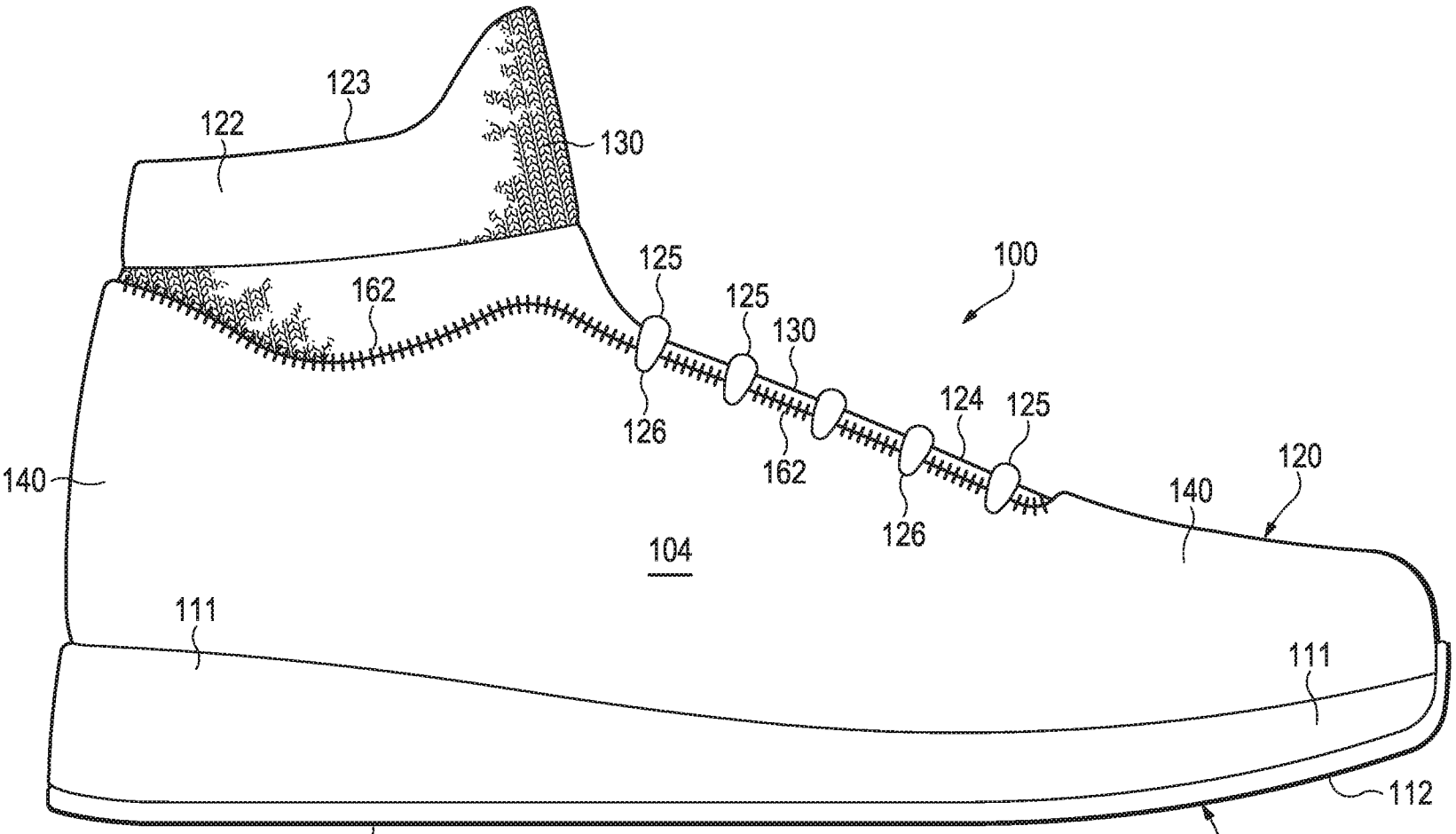
Figure 12C:
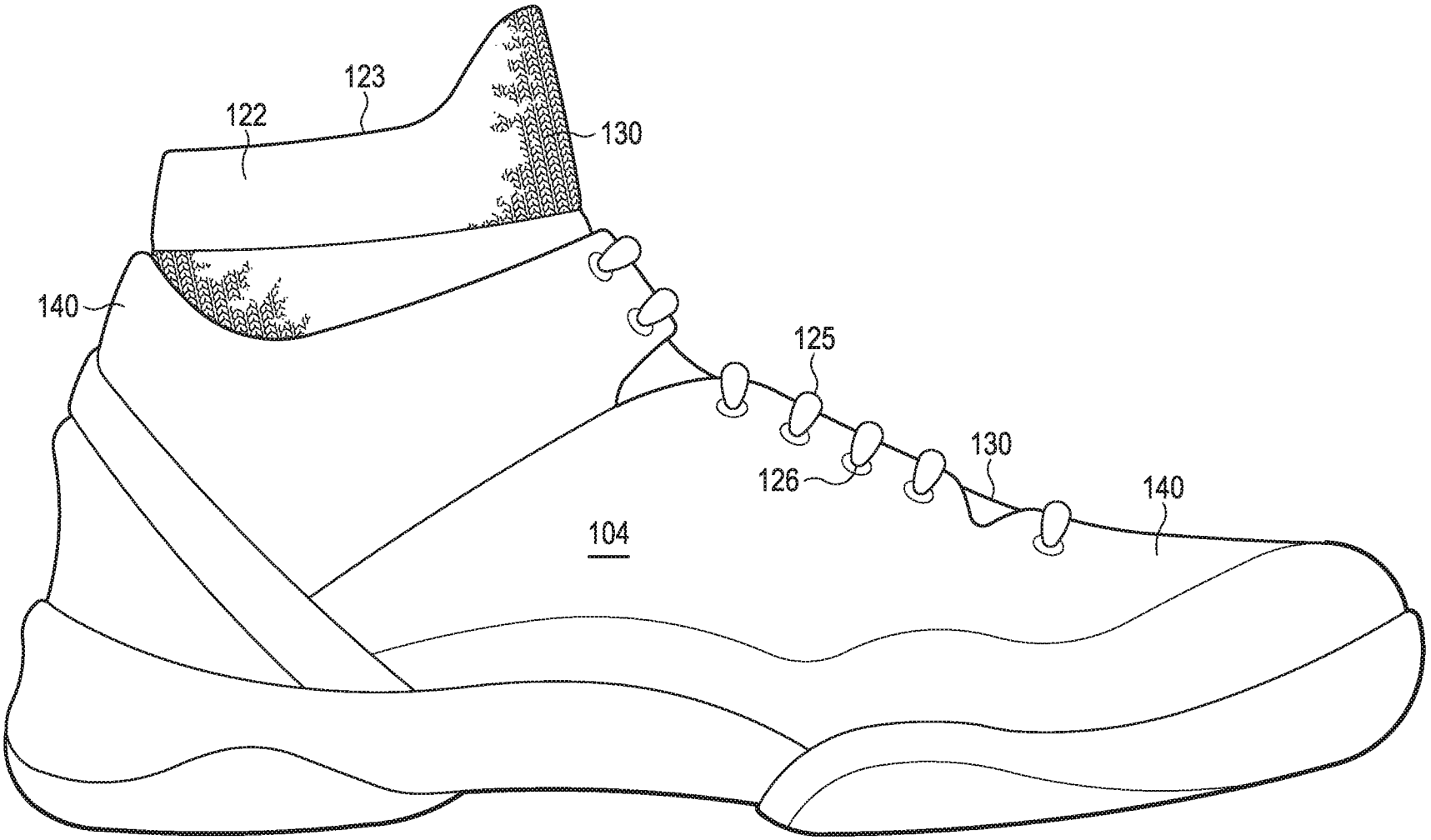

The configuration of footwear 100 and knitted component 130 discussed above and depicted in the figures provides one example relating to the structure of footwear 100 and knitted component 130. In further configurations, numerous features of footwear 100 and knitted component 130 may vary considerably. Referring to FIG. 12A, for example, a plurality of looped strands 161 form lace-receiving elements and replace apertures 126. Looped strands 161 extend upward from a lower area of upper 120 and form loops, through which lace 125 extends. Further information regarding structures similar to looped strands 161 may be found in U.S. patent application Ser. No. 13/529,381, which was filed in the U.S. Patent and Trademark Office on 21 Jun. 2012 and is entitled Footwear Incorporating Looped Tensile Strand Elements, such application being entirely incorporated herein by reference. Although knitted component 130 may be separable and replaceable, FIG. 12B depicts a configuration where stitching 162 joins knitted component 130 to cover component 140. Although footwear 100 may have the configuration of a running shoe, another configuration of footwear 100 is depicted in FIG. 12C as having the configuration of a basketball shoe.

Figure 13A:
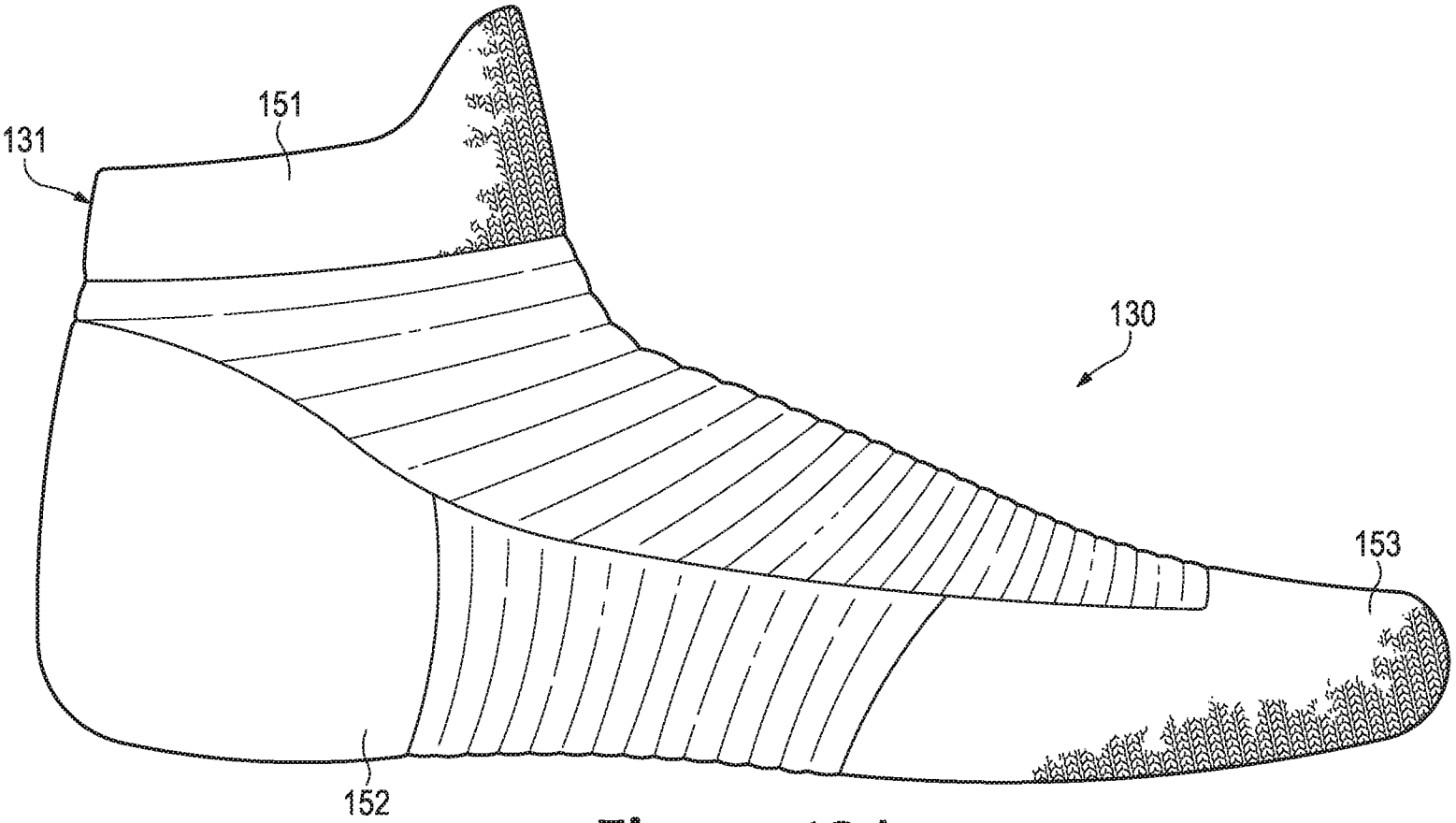
FIGS. 13A-13D are lateral side elevational views corresponding with FIG. 8 and depicting further configurations of the knitted component.
Figure 13B:
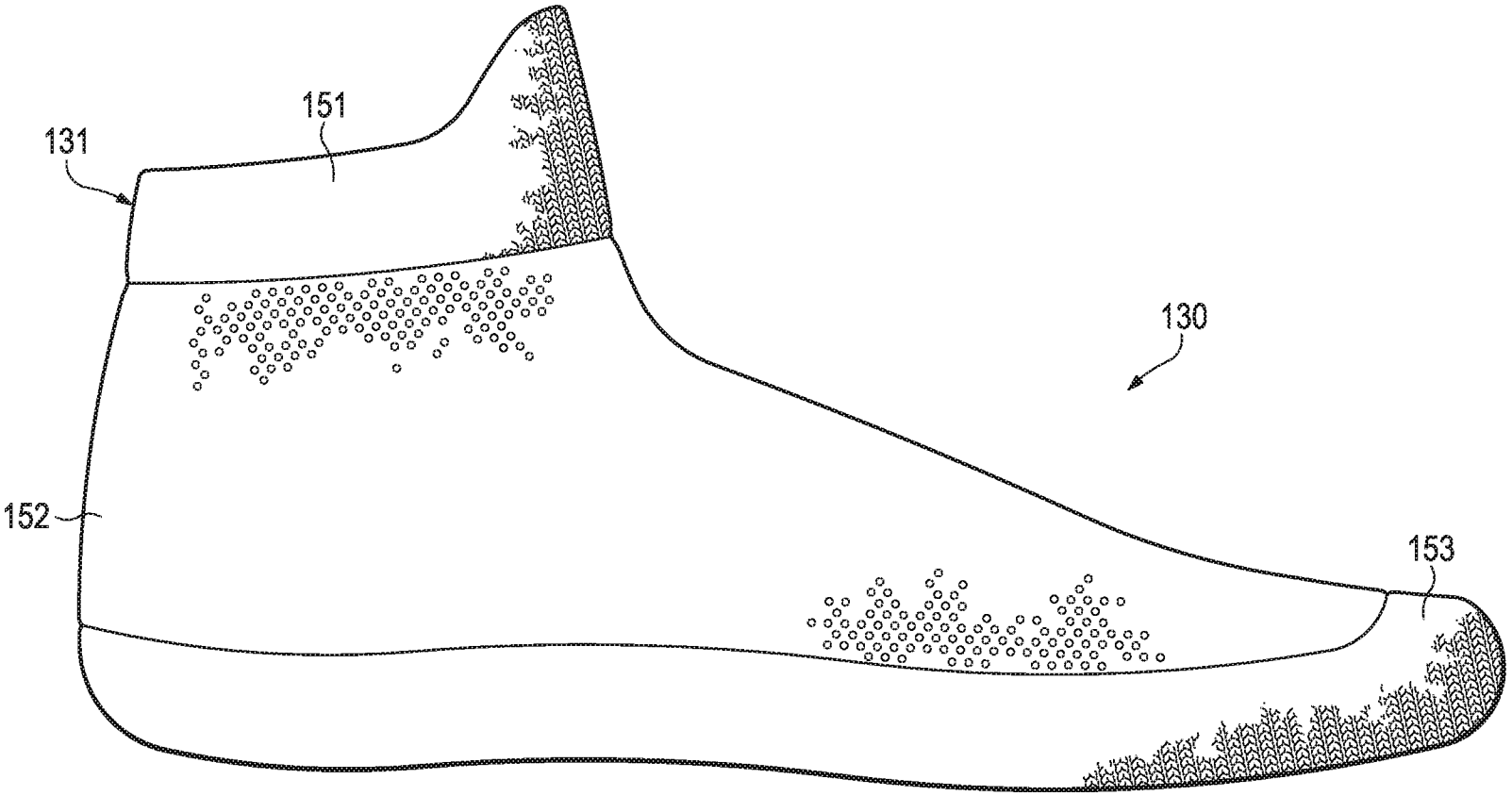
Figure 13C:
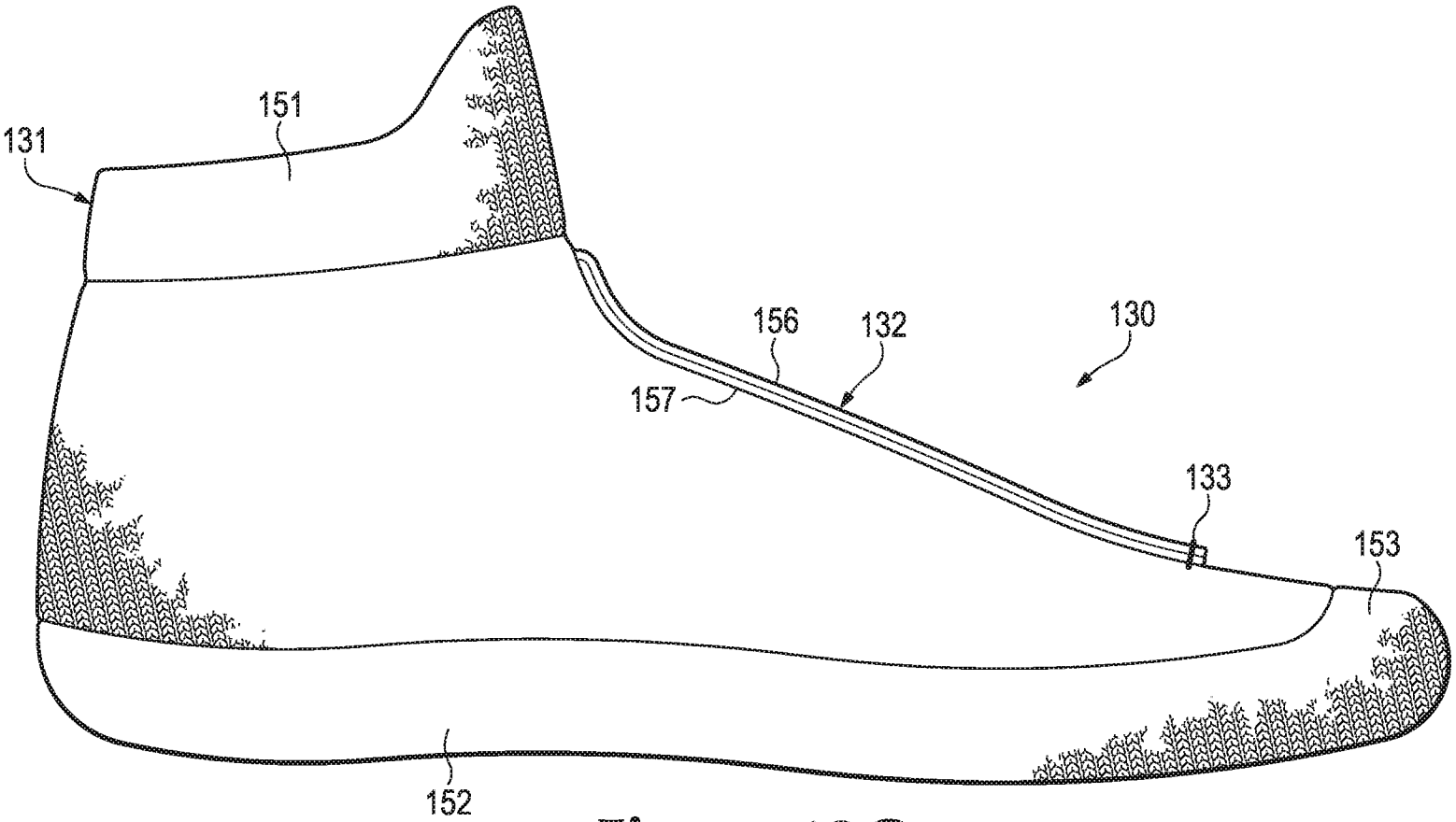
Figure 13D:
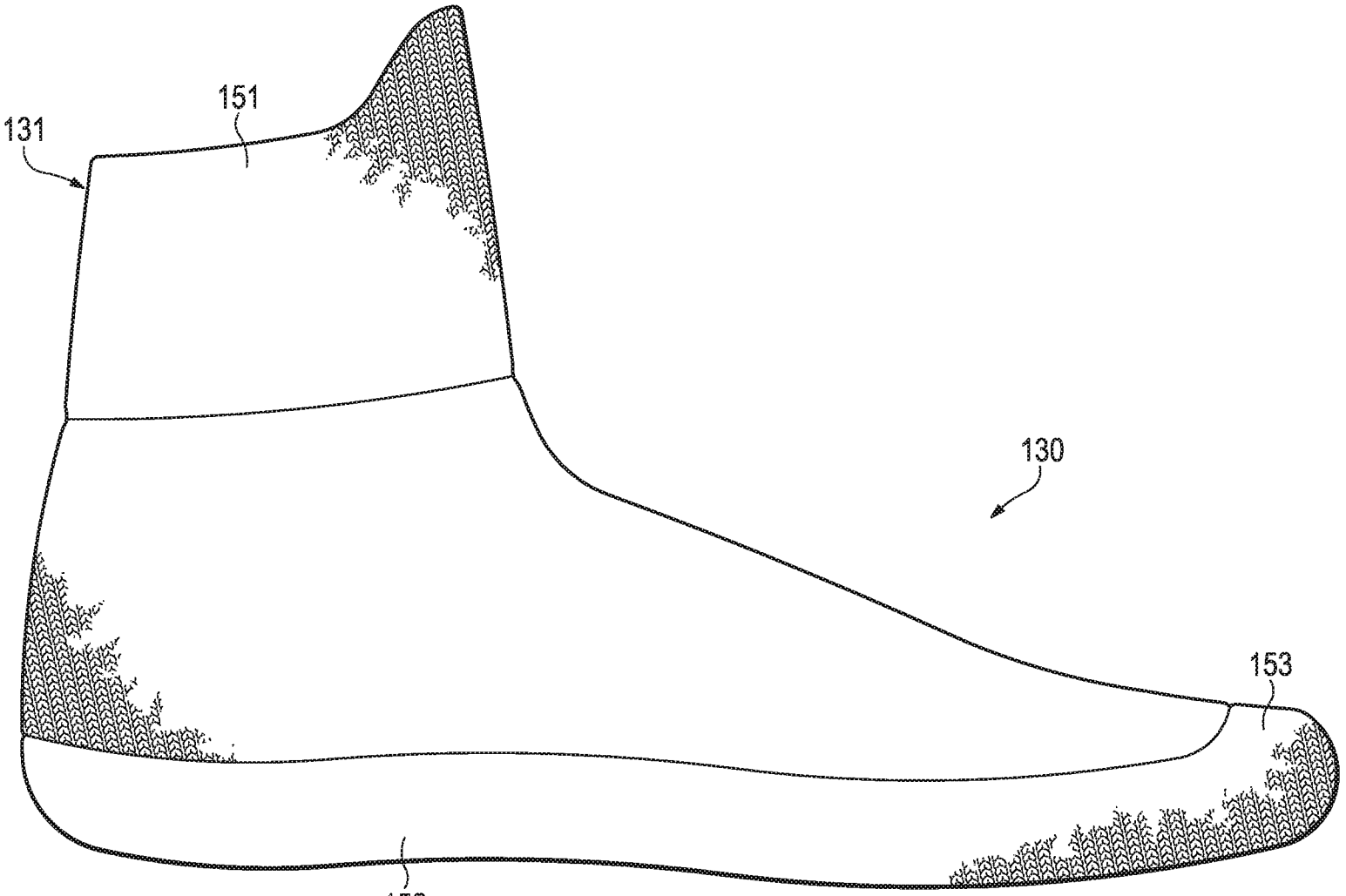

In addition to variations in other areas of footwear 100, numerous features of knitted component 130 may vary considerably. Referring to FIG. 13A, knitted component 130 includes a rib knit structure. More particularly, substantially all of an upper surface of foot area 152 has the rib knit structure. In addition, a portion of the lower surface of foot area 152 that corresponds with the position of the arch of the foot has the rib knit structure. In comparison with other knit structures, the rib knit structure may be utilized to impart significant stretch to knitted component 130. In another configuration that is depicted in FIG. 13B, side regions of foot area 152 have a mesh knit structure that forms a plurality of holes or apertures in knitted component 130. An advantage of the mesh knit structure relates to breathability. Although tongue portion 132 may be located within sock portion 131, FIG. 13C depicts a configuration where tongue portion 132 is located on the exterior of sock portion 131.

Figure 14A:
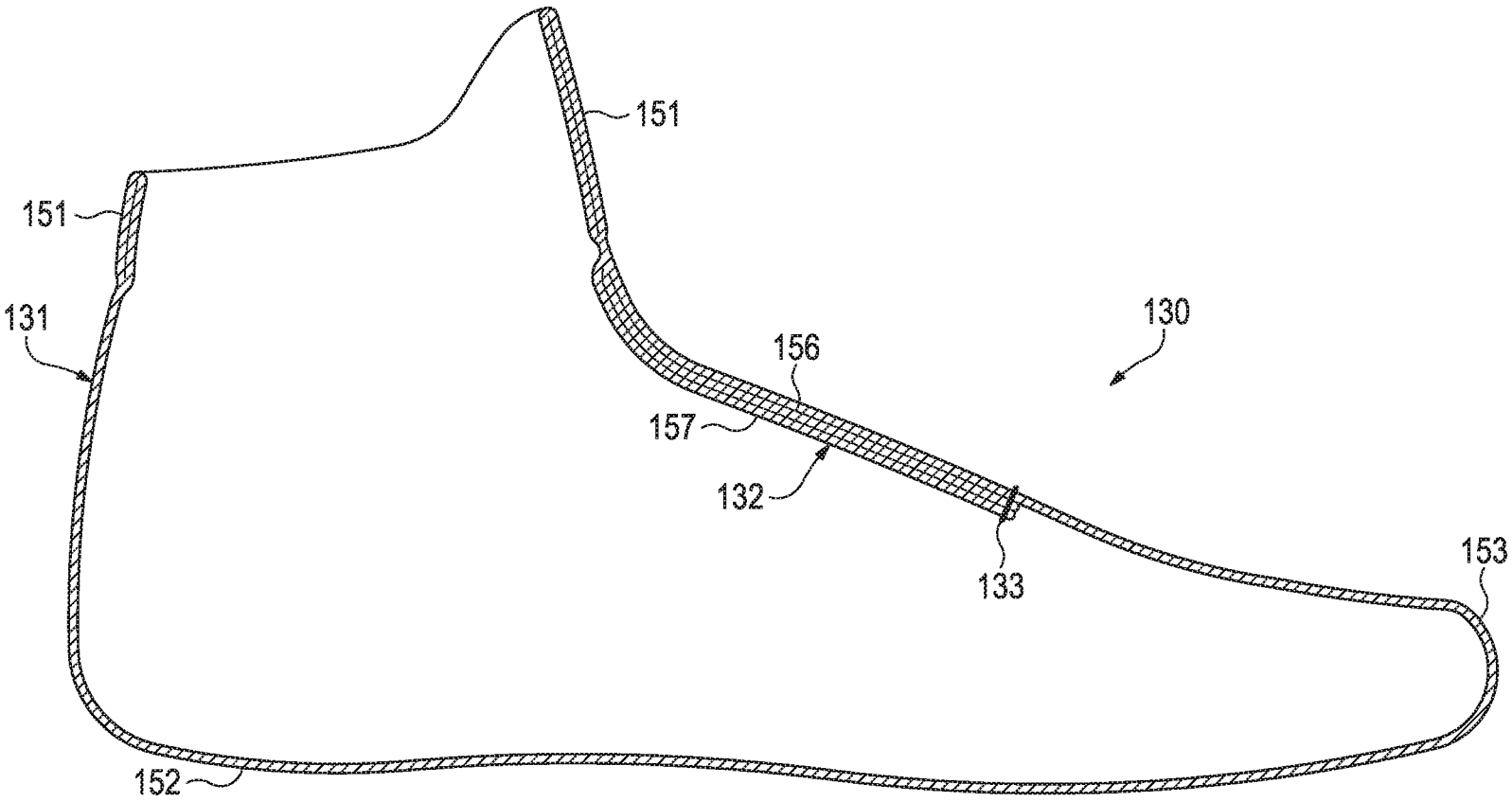
FIGS. 14A-14F are cross-sectional views corresponding with FIG. 11D and depicting further configurations of the knitted component.
Figure 15A:
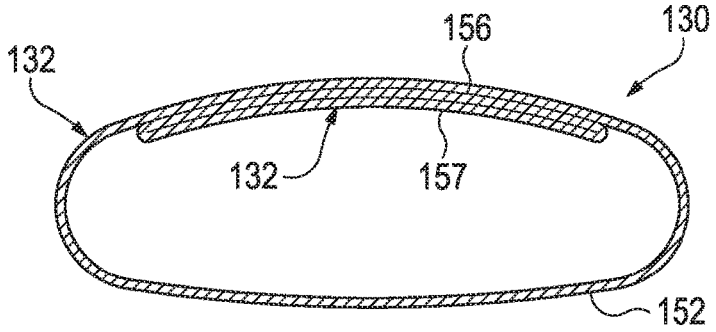
FIGS. 15A-15D are cross-sectional views corresponding with FIG. 11C and depicting further configurations of the knitted component.
Figure 15B:
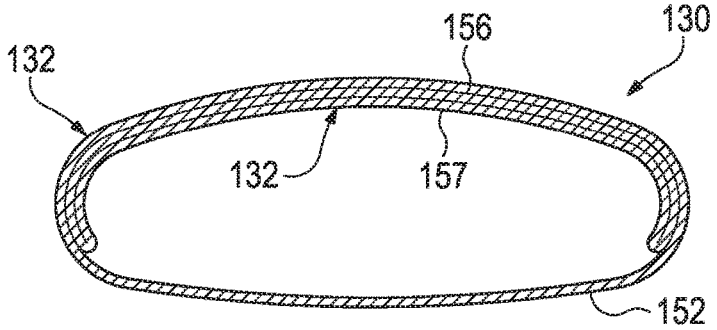
Figure 15C:
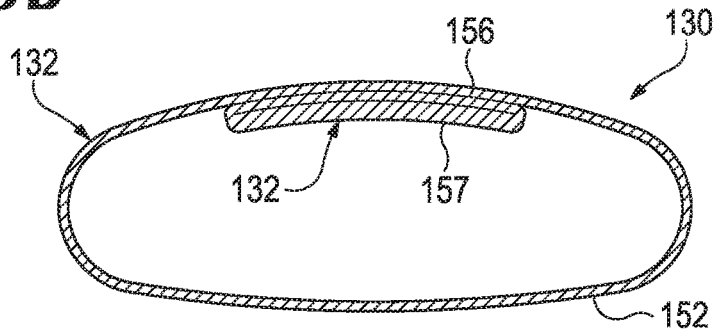

In some variations, the proportions of knitted component 130 may vary. As an example, FIG. 130 depicts collar area 151 as having greater height, which would cover more of the ankle of the wearer. Referring to FIG. 14A, tongue portion 132 exhibits a reduced length that would extend through less of throat area 124. FIG. 15A depicts a configurations where tongue portion 132 has greater width. Similarly, the width of tongue portion 132 is also greater in FIG. 15B and extends to side areas of sock portion 131. As a further variation, FIG. 15C depicts second knit layer 157 as having an increased thickness, which may be formed by varying the knit structure or type of yarn.

Figure 14B:
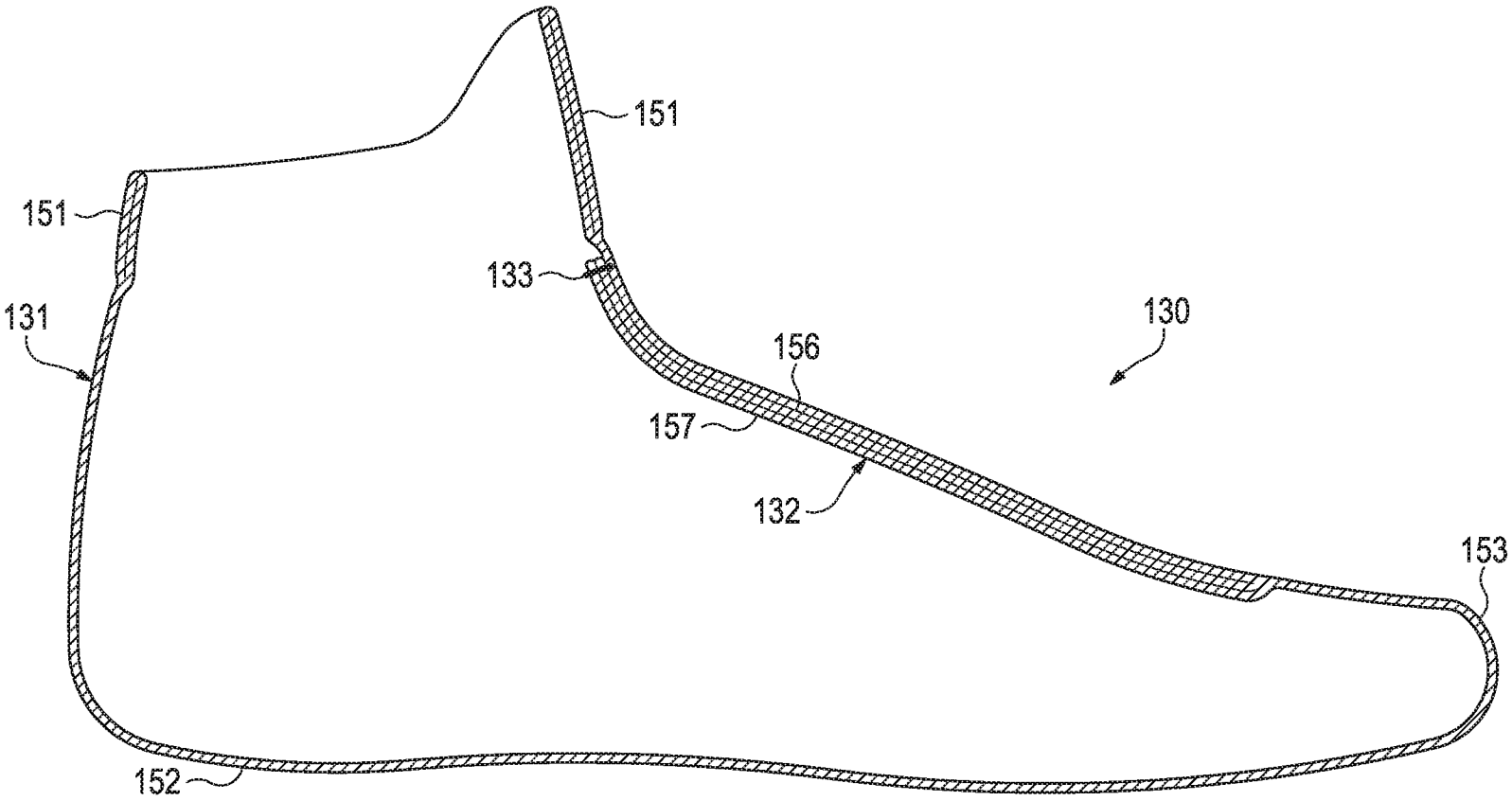
Figure 14C:
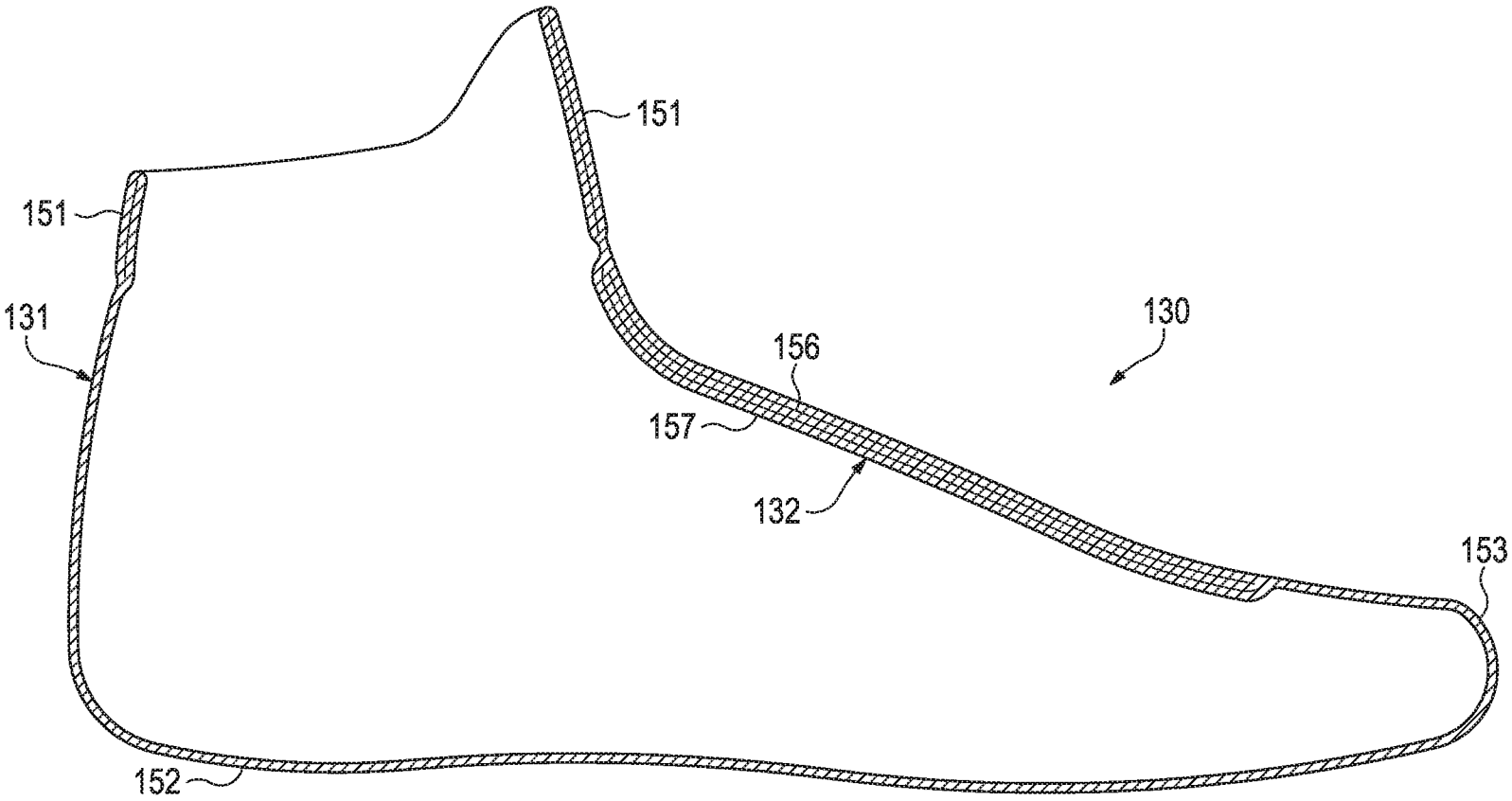
Figure 14D:
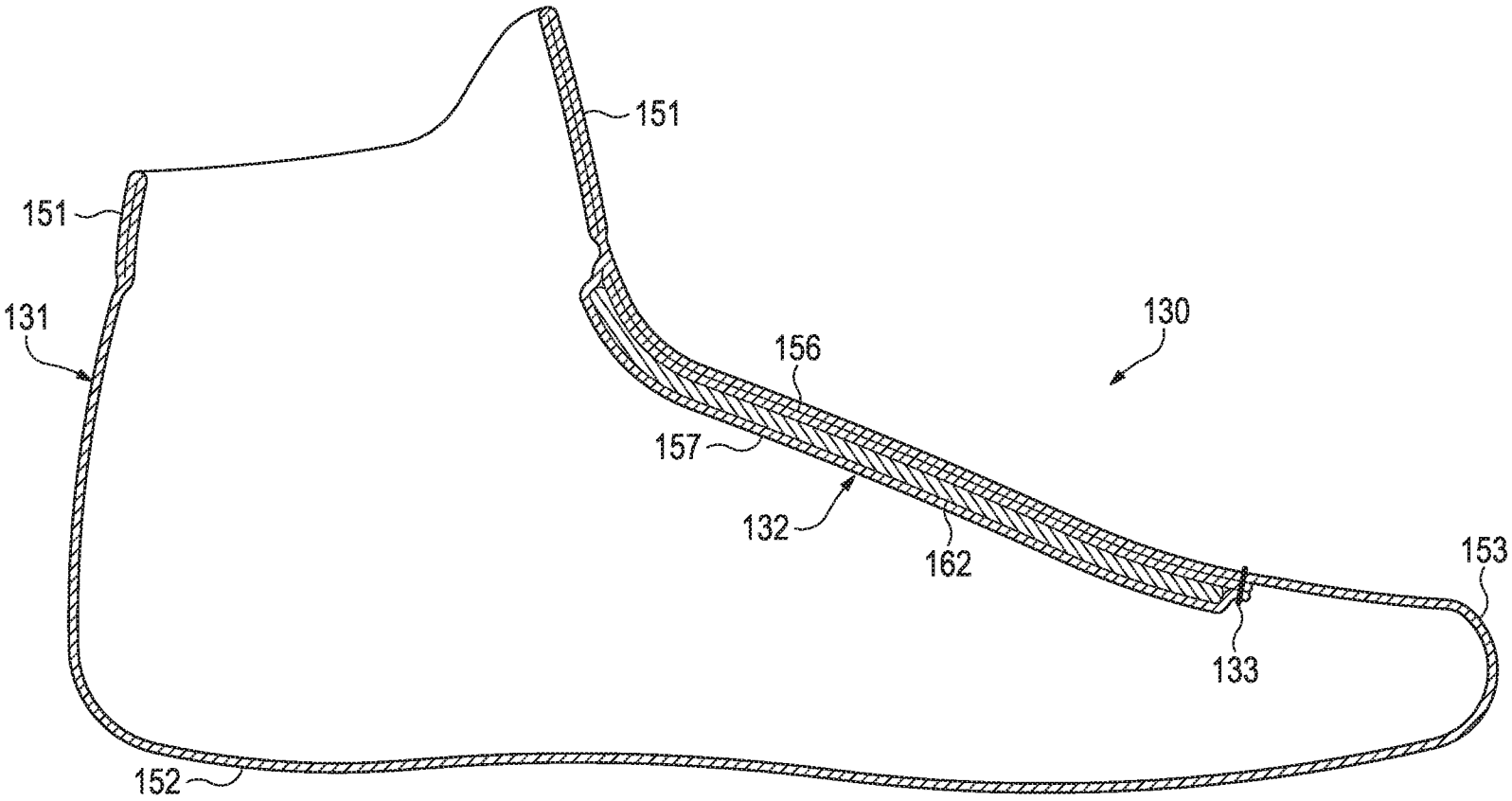
Figure 14E:
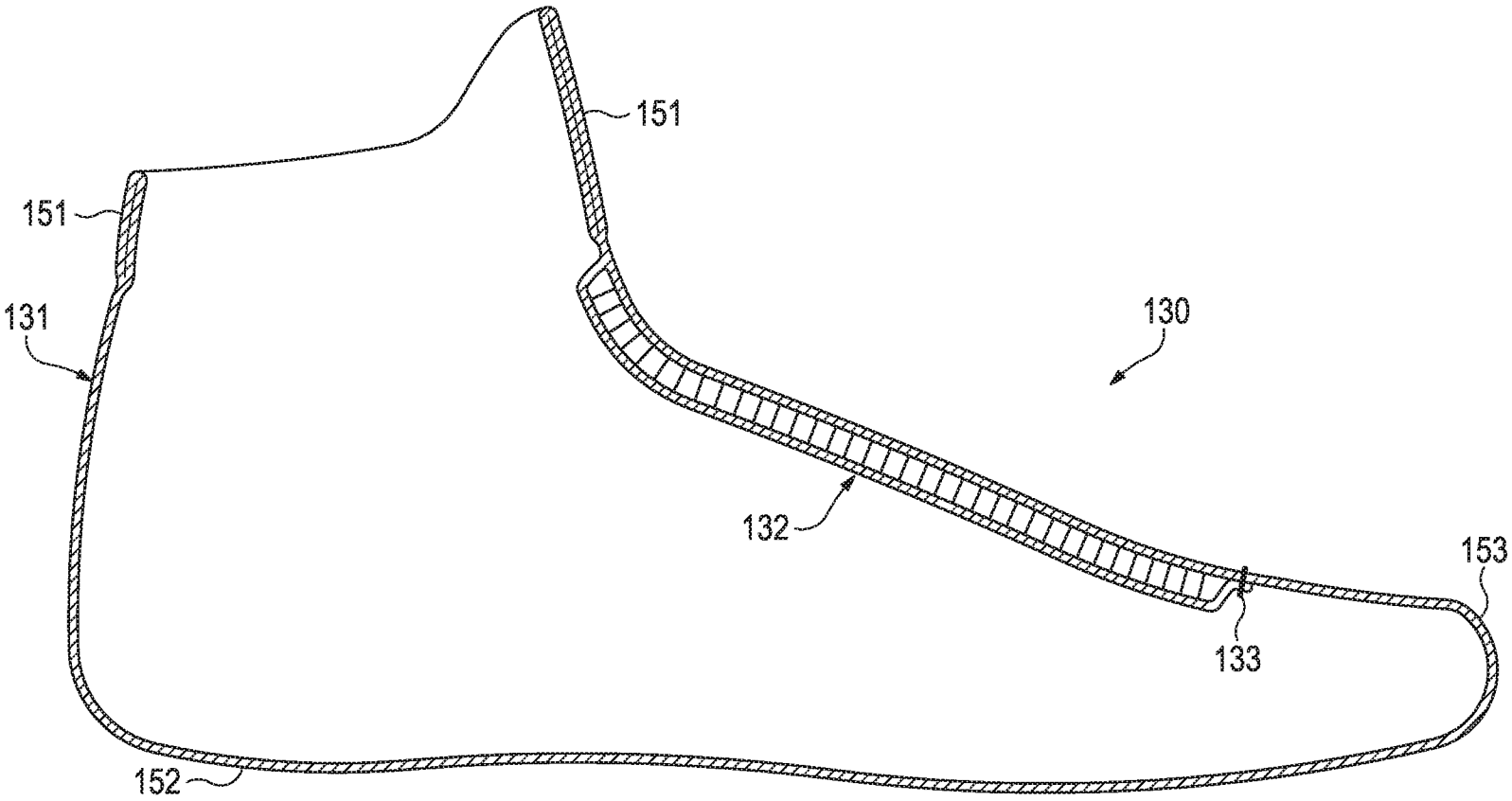
Figure 14F:
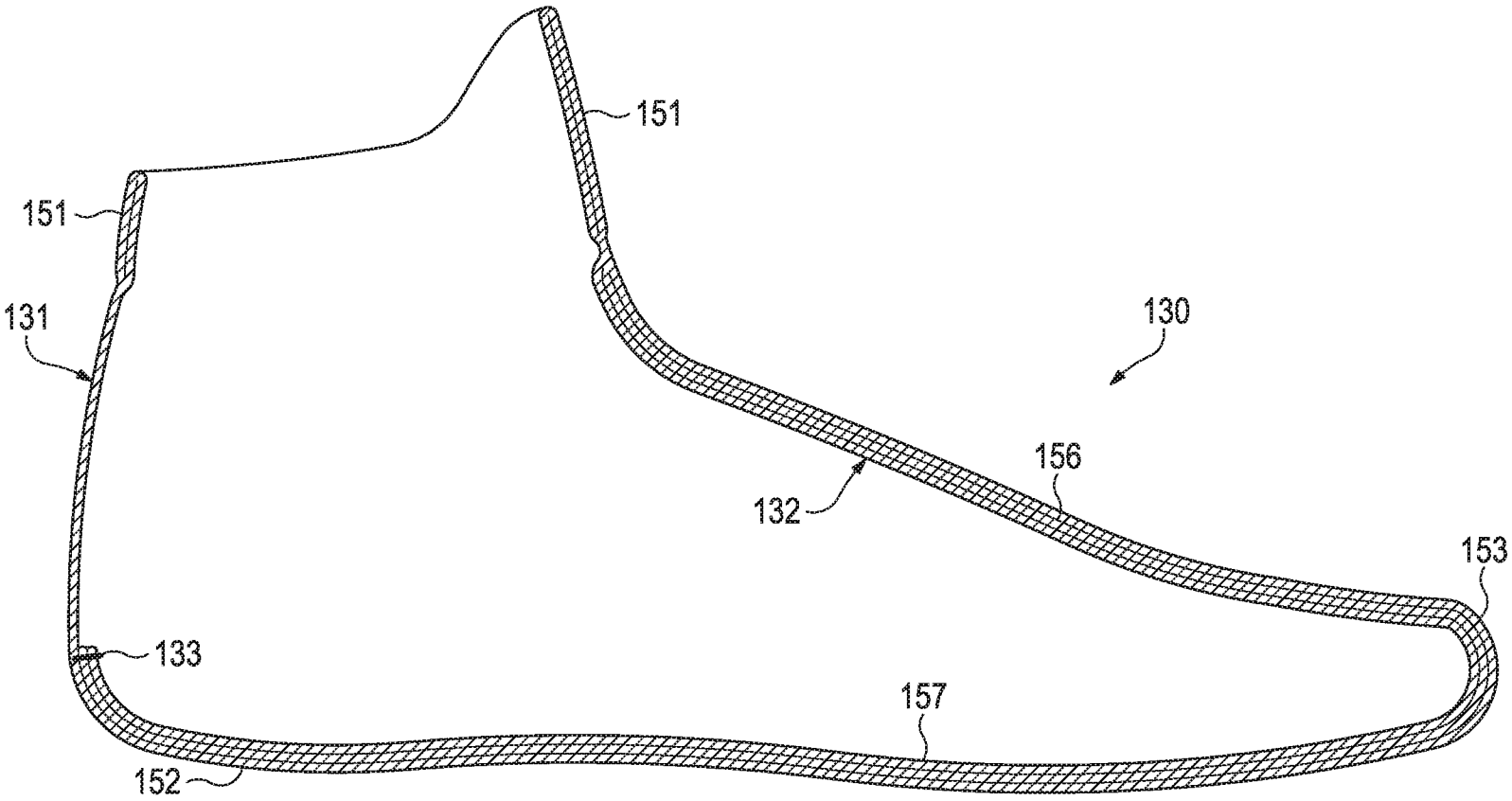
Figure 15D:
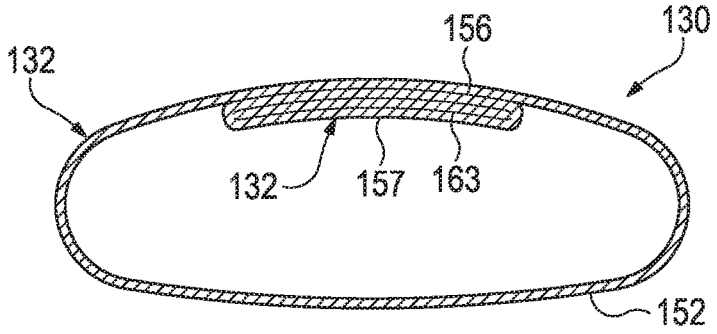

Numerous other aspects of knitted component 130 may also vary. Referring to FIG. 14B, toe end 155 is stitched to sock portion 131, whereas collar end 154 is formed of unitary knit construction with sock portion 131. In FIG. 14C, both of ends 154 and 155 are formed of unitary knit construction with sock portion 131. In order to provide more cushioning and separation between the foot and lace 125, the thickness of one of knit layers 156 and 157 may be increased, as in FIG. 15C. As further examples, FIG. 14D depicts a foam element 162 located between knit layers 156 and 157, and FIG. 15D depicts tongue portion 132 as having an additional knit layer 163. Referring to FIG. 14E, tongue portion 132 is formed to have the configuration of a spacer material, in which drop yarns extend between sock portion 131 and tongue portion 132 to provide cushioning. As a final example, FIG. 14F depicts a configuration wherein tongue portion 132 is located to extend under the foot and may provide cushioning similar to a sockliner.

Knitting Process

A knitting process may be utilized to form knitted component 130 and many or all of the various features discussed above for knitted component 130. It should be noted, however, that weaving processes may also be utilized to form a textile element having many or all of the various features discussed above for knitted component 130. Although a knitting process that forms knitted component 130 may be performed by hand, the commercial manufacture of multiple knitted components 130 will generally be performed by knitting machines. In general, knitting involves forming courses and wales of intermeshed loops of a yarn or multiple yarns. In production, knitting machines may be programmed to mechanically-manipulate one or more yarns into the configuration of knitted component 130. That is, knitted component 130 may be formed by mechanically-manipulating one or more yarns to form a one-piece textile element that has the shape and features of knitted component 130. As such, knitted component may be formed of unitary knit construction utilizing a knitting machine.

Although knitted component 130 may be formed through a variety of different knitting processes and using a variety of different knitting machines, circular knitting (i.e., the use of a circular knitting machine) has the capability of forming knitted component 130 to have the various features discussed above. In general, circular knitting involves forming a plurality of courses and wales. As an example, courses are circular rows of loops that extend entirely around sock portion 131 and across the width of tongue portion 132. Wales are columns of loops that extend perpendicular to the courses and from (a) collar area 151 to toe area 153 and (b) collar end 154 to toe end 155. Although general or conventional circular knitting processes may be utilized to form knitted component 130, specific examples of knitting processes that may be utilized include wide tube circular knitting, narrow tube circular knitting, narrow tube circular knit jacquard, single knit circular knit jacquard, double knit circular knit jacquard, warp knit jacquard, and flat knitting, for example.

The knitting process for forming knitted component 130 will now be discussed in greater detail. As noted above, sock portion 131 has the general configuration of a sock. That is, sock portion 131 may incorporate various features and knit structures that are commonly utilized in socks that are intended to cover a foot. The portion of the knitting process that forms sock portion 131 is, therefore, well-known in the art of knitting. In contrast with a conventional sock, however, knitted component 130 includes tongue portion 132. In order to knit tongue portion 132 with sock portion 131, the general knitting process may proceed as follows: Initially, the knitting machine knits a first circular course that forms a portion of collar area 151 and transfers the first circular course to a dial that holds the first circular course throughout a remainder of the knitting process. Various other circular courses that form portions of collar area 151 may also be formed. In knitting tongue portion 132, the knitting machine may reciprocate to form each of knit layers 156 and 157. Once the reciprocation is complete and tongue portion 132 is formed, the knitting machine may proceed with forming one or more additional circular courses that form portions of collar area 151, and one of these additional circular courses may be joined with the first circular course held upon the dial. At this point, portions of collar area 151 and tongue portion 132 are formed, and the knitting process may proceed in a well-known manner to form a remainder of sock portion 131. In effect, therefore, the knitting process for knitted component 130 is similar to the conventional process for forming a sock, but includes additional reciprocation steps to form tongue portion 132.

Many aspects of the knitting process discussed above may be performed using a conventional circular knitting machine. In order to facilitate some portions of the knitting process, however, the circular knitting machine may be modified to raise and lower the dial, which holds the first course formed in knitted component 130. Additionally, a blower may be utilized to ensure that knitted component 130 remains properly located within the circular knitting machine during the knitting process.

Based upon the discussion above, A circular knitting process forms knitted component 130. Once the knitting process is complete, knitted component 130 may be incorporated into upper 120. More particularly, knitted component 130 is located within cover component 140 and to extend from forefoot region 101 to heel region 103. Moreover, knitted component 130 is oriented such that tongue portion 132 is located to extend through at least a portion of a length of throat area 124. In configurations where knitted component is secured to cover component 140, either stitching, adhesive bonding, or thermal bonding may be used.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

I claim:

1. An upper for an article of footwear, comprising:

a knitted component including a sock portion and a tongue portion, the sock portion having a hollow structure and a toe area, the hollow structure (a) forming an ankle opening in a heel region of the footwear and (b) extending between the heel region and a forefoot region of the footwear to define a void within the footwear for receiving a foot, the knitted component only having a single layer in the toe area, the tongue portion having an elongate configuration (a) located in at least a portion of a length of a throat area of the upper and (b) including at least two knit layers that are coextensive, wherein the sock portion overlays the tongue portion in the throat area of the upper, and wherein a first end of the tongue portion shares a common knit structure with the sock portion to secure the tongue portion to the sock portion.

2. The upper of claim 1, wherein a second end of the tongue portion is stitched to the sock portion, the first end being opposite the second end.

3. The upper of claim 2, wherein a non-knit stitch forms the stitch.

4. The upper of claim 2, wherein the second end of the tongue portion is located adjacent to the toe area of the upper.

5. The upper of claim 1, wherein the first end of the tongue portion is located adjacent to a collar of the upper.

6. The upper of claim 1, wherein the common knit structure includes at least one common knit course.

7. The upper of claim 1, wherein (a) peripheral areas of the knit layers are joined to each other and (b) central areas of the knit layers are unjoined to each other.

8. An upper for an article of footwear, comprising:

a knitted component including a sock portion and a tongue portion, the sock portion having a hollow structure and a toe area, the hollow structure (a) forming an ankle opening in a heel region of the footwear and (b) extending between the heel region and a forefoot region of the footwear to define a void within the footwear for receiving a foot, the knitted component only having a single layer in the toe area, the tongue portion having an elongate configuration (a) located in at least a portion of a length of a throat area of the upper and (b) including at least two knit layers that are coextensive, wherein the sock portion overlays the tongue portion in the throat area of the upper, and wherein a first end of the tongue portion and the sock portion have a unitary knit construction.

9. The upper of claim 8, wherein a second end of the tongue portion is stitched to the sock portion, the first end being opposite the second end.

10. The upper of claim 9, wherein the second end of the tongue portion is located adjacent to the toe area of the upper.

11. The upper of claim 9, wherein a non-knit stitch forms the stitch.

12. The upper of claim 8, wherein the first end of the tongue portion is located adjacent to a collar of the upper.

13. The upper of claim 8, wherein (a) peripheral areas of the knit layers are joined to each other and (b) central areas of the knit layers are unjoined to each other.

14. An upper for an article of footwear, comprising:

a knitted component including a sock portion and a tongue portion, the sock portion having a hollow structure and a toe area, the hollow structure (a) forming an ankle opening in a heel region of the footwear and (b) extending between the heel region and a forefoot region of the footwear to define a void within the footwear for receiving a foot, the knitted component only having a single layer in the toe area the tongue portion having an elongate configuration (a) located in at least a portion of a length of a throat area of the upper and (b) including at least two knit layers that are coextensive, wherein the sock portion overlays the tongue portion in the throat area of the upper, wherein a first end of the tongue is secured to the sock portion via a knit structure to secure the tongue portion to the sock portion, and wherein a second end of the tongue portion is secured to the sock portion with a non-knit structure, the first end being opposite the second end.

15. The upper of claim 14, wherein the non-knit structure includes stitching.

16. The upper of claim 14, wherein the second end of the tongue portion is located adjacent to the toe area of the upper.

17. The upper of claim 14, wherein the first end of the tongue portion is located adjacent to a collar of the upper.

18. The upper of claim 14, wherein the knit structure includes at least one common knit course that includes loops connecting the first end of the tongue portion with the sock portion.

19. The upper of claim 14, wherein (a) peripheral areas of the knit layers are joined to each other and (b) central areas of the knit layers are unjoined to each other.

* * * * *